US012753540B2

(12) United States Patent
Lee et al.

(10) Patent No.: US 12,753,540 B2
(45) Date of Patent: Oct. 6, 2026

(54) APPARATUS FOR TREATING LAUNDRY

(71) Applicant: LG ELECTRONICS INC., Seoul (KR)

(72) Inventors: Kilryong Lee, Seoul (KR); Bokyung Cho, Seoul (KR); Yongwoo Kwon, Seoul (KR); Inseong Hwang, Seoul (KR); Hakryeol Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 98 days.

(21) Appl. No.: 18/873,660

(22) PCT Filed: Jun. 15, 2023

(86) PCT No.: PCT/KR2023/008295
§ 371 (c)(1),
(2) Date: Dec. 10, 2024

(87) PCT Pub. No.: WO2023/244039
PCT Pub. Date: Dec. 21, 2023

(65) Prior Publication Data

US 2025/0361666 A1 Nov. 27, 2025

(30) Foreign Application Priority Data

Jun. 16, 2022 (KR) ..... 10-2022-0073531

(51) Int. Cl.
*D06F 29/00* (2006.01)
*D06F 31/00* (2006.01)
(Continued)

(52) U.S. Cl.
CPC ..... *D06F 34/34* (2020.02); *D06F 29/005* (2013.01); *D06F 31/00* (2013.01); *D06F 34/08* (2020.02);
(Continued)

(58) Field of Classification Search
USPC ..... 68/20
See application file for complete search history.

(56) References Cited

U.S. PATENT DOCUMENTS

2014/0157673 A1 6/2014 Bazzinotti
2021/0254264 A1 8/2021 Kwon et al.

FOREIGN PATENT DOCUMENTS

CN 104452194 A 3/2015
KR 10-2005-0058015 A 6/2005
(Continued)

*Primary Examiner* — Levon J Shahinian
(74) *Attorney, Agent, or Firm* — Bryan Cave Leighton Paisner LLP

(57) ABSTRACT

The present invention provides an apparatus for treating laundry. In an embodiment, an apparatus for treating laundry comprises: a first treatment device having a first drum having a first front panel provided on the front side thereof, and accommodating laundry therein; a second treatment device arranged on the upper side of the first treatment device and having a second drum having a second front panel provided on the front side thereof, and accommodating laundry therein; and a control panel which is provided between the first front panel and the second front panel and which is provided with a user interface (UI) for controlling at least one of the first treatment device and the second treatment device, wherein the control panel comprises a cover panel forming an appearance, and an electronic module coupled to the rear side of the cover panel, wherein the electronic module comprises a flat panel display, and a supporter on which a display seating part for supporting the flat panel display is formed, wherein a first sealing part, which surrounds an outer area than the display seating part and has a first sealer located therein, is provided on the front surface of the supporter.

20 Claims, 26 Drawing Sheets

(51) Int. Cl.

| | |
|---|---|
| ***D06F 34/08*** | (2020.01) |
| ***D06F 34/30*** | (2020.01) |
| ***D06F 34/32*** | (2020.01) |
| ***D06F 34/34*** | (2020.01) |
| ***D06F 37/26*** | (2006.01) |
| ***D06F 37/42*** | (2006.01) |
| ***D06F 39/12*** | (2006.01) |
| ***D06F 58/32*** | (2020.01) |

(52) U.S. Cl.

CPC ..... *D06F 34/30* (2020.02); *D06F 34/32* (2020.02); *D06F 37/263* (2013.01); *D06F 37/42* (2013.01); *D06F 39/12* (2013.01); *D06F 58/32* (2020.02)

(56) References Cited

FOREIGN PATENT DOCUMENTS

| | | | |
|---|---|---|---|
| KR | 10-2006-0089083 | A | 8/2006 |
| KR | 10-1708355 | B1 | 2/2017 |
| KR | 10-2021-0112086 | A | 9/2021 |
| KR | 10-2021-0112225 | A | 9/2021 |

APPARATUS FOR TREATING LAUNDRY

CROSS-REFERENCE TO PRIOR APPLICATIONS

This application is a National Stage of PCT/KR2023/008295, filed Jun. 15, 2023. (published on Dec. 21, 2023, as WO 2023/244039 A1), which claims priority to Korean Patent Application No. 10-2022-0073531, filed Jun. 16, 2022, each hereby expressly incorporated by reference in its entirety.

TECHNICAL FIELD

The present disclosure relates to a laundry treatment apparatus.

BACKGROUND ART

A laundry treatment apparatus is an apparatus designed to receive laundry such as clothes and bedclothes in a drum thereof and to perform a laundry treatment such as elimination of contaminants from the laundry or drying of the laundry.

When a laundry treatment apparatus is designed to eliminate contaminants from laundry, the laundry treatment apparatus is capable of performing washing, rinsing, dewatering, spin-drying and the like. The laundry treatment apparatus may include a cabinet defining the appearance, a tub received in the cabinet, a drum rotatably mounted in the tub and receiving laundry therein, and a detergent supply unit configured to supply detergent to the inside of the drum. When the drum is rotated by a motor in the state in which washing water is supplied to the laundry received in the drum, contaminants may be eliminated from the laundry by virtue of frictional action between the laundry and the drum and the washing water.

When a laundry treatment apparatus is designed to dry laundry, the laundry treatment apparatus is capable of removing moisture from laundry by supplying dry air to the laundry. The laundry treatment apparatus may include a cabinet, a drum rotatably provided in the cabinet, a heating unit configured to heat or dry air supplied to the laundry and the like. By supplying dry air to the laundry received in the drum, the moisture contained in the laundry may evaporate and be removed by the dry air, and water in the laundry may be removed.

Korea unexamined patent application publication No. 10-2008-0021921A1 (Related patent document 1) discloses a laundry treatment apparatus which is provided with a plurality of stacked treatment apparatuses. The laundry treatment apparatus is constructed such that a first treatment apparatus is provided at an upper level and a second treatment apparatus is provided at a lower level. Each of the first treatment apparatus and the second treatment apparatus includes a manipulation unit and a display unit. In other words, the related patent document 1 discloses the laundry treatment apparatus including a plurality of treatment apparatuses each of which includes the manipulation unit and the display unit. However, the laundry treatment apparatus is problematic in that a user must check the plurality of treatment apparatuses and respectively manipulate the plurality of treatment apparatuses and that it is disadvantageous to operate the plurality of treatment apparatuses in linkage with each other.

Korea unexamined patent application publication No. 10-2021-0112087 (Related patent document 2) discloses a laundry treatment apparatus including a plurality of stacked treatment apparatuses in which both a first treatment apparatus and a second treatment apparatus are manipulated via a single control panel. The related patent document 2 discloses a structure in which the control panel is coupled between the first treatment apparatus and the second treatment apparatus. However, the related patent document 2 does not disclose effective coupling relationships between components constituting the control panel.

DISCLOSURE

Technical Task

An object of the present disclosure is to provide a structure capable of improving workability in coupling between components constituting a control panel.

An object of the present disclosure is to provide a laundry treatment apparatus capable of realizing a simple and clear design of a user interface (UI) by providing a control panel including a flat display and constructing the control panel using the flat display.

An object of the present disclosure is to provide a structure capable of protecting a flat display, which is weak to humidity, from circumstances in which a laundry treatment apparatus is always exposed to humidity.

An object of the present disclosure is to provide a coupling structure in which components constituting a control panel are stably coupled to each other so as to maintain sealing performance.

An object of the present disclosure is to provide a laundry treatment apparatus capable of reducing quality deterioration of a screen which is transmitted to a user through a cover panel in construction of a control panel including a flat display.

Objects, which are intended to be solved by the present disclosure, are not limited to the above-mentioned objects, and other objects of the present disclosure, which are not mentioned above, will be clearly understood by those skilled in the art from the following descriptions.

Technical Solutions

The present disclosure provides a laundry treatment apparatus. In an embodiment, the laundry treatment apparatus includes a first treatment apparatus including a first front panel provided at a front side thereof and a first drum configured to receive laundry therein, a second treatment apparatus disposed on the first treatment apparatus, the second treatment apparatus including a second front panel provided at a front side thereof and a second drum configured to receive laundry therein, and a control panel provided between the first front panel and the second front panel and providing a user interface (UI) configured to control at least one of the first treatment apparatus or the second treatment apparatus, wherein the control panel includes a cover panel defining an appearance of the control panel, and an electrical component module coupled to a rear side of the cover panel, and wherein the electrical component module includes a flat display, a supporter including a display seating portion configured to support the flat display, and a first sealing portion which is provided on a front surface of the supporter so as to surround a region outside the display seating portion and at which a first sealer is positioned.

Advantageous Effects

According to an embodiment of the present disclosure, it is possible to obtain a structure capable of improving workability in coupling between components constituting a control panel.

According to an embodiment of the present disclosure, it is possible to realize a simple and clear design of a user interface (UI) by providing a control panel including a flat display and constructing the control panel using the flat display.

According to an embodiment of the present disclosure, it is possible to protect a flat display, which is weak to humidity, from circumstances in which a laundry treatment apparatus is always exposed to humidity.

According to an embodiment of the present disclosure, it is possible to obtain a coupling structure in which components constituting a control panel are stably coupled to each other so as to maintain sealing performance.

According to an embodiment of the present disclosure, it is possible to reduce quality deterioration of a screen which is transmitted to a user through a cover panel in construction of a control panel including a flat display.

Effects of the present disclosure are not limited to the above-mentioned effects, and other effects of the present disclosure, which are not mentioned above, will be clearly understood by those skilled in the art to which the present disclosure belongs, from the following detailed description and the accompanying drawings.

BEST MODE FOR DISCLOSURE

Figure 1:
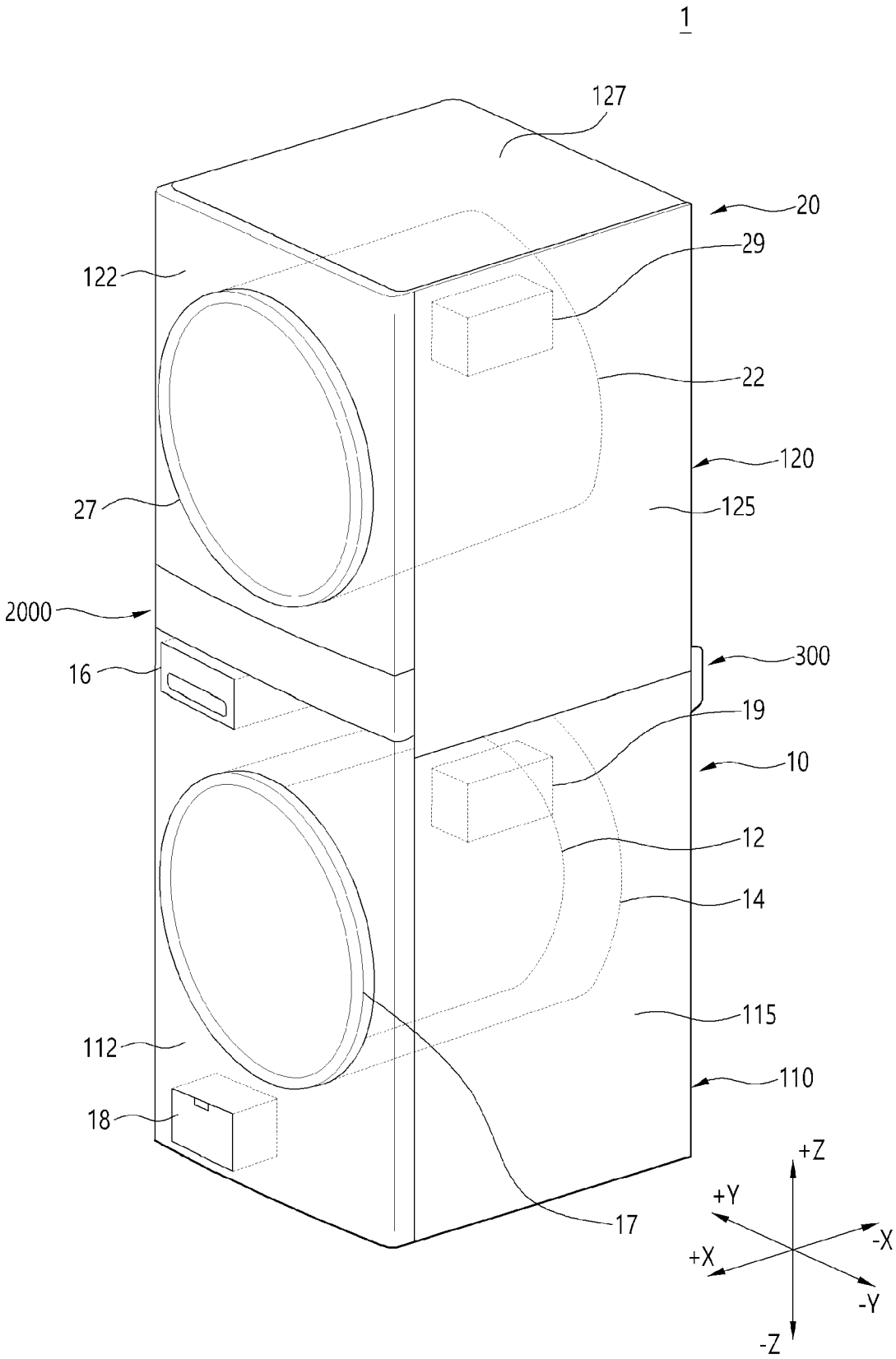
FIG. 1 is a perspective view of a laundry treatment apparatus according to an embodiment of the present disclosure.

Hereinafter, with reference to the accompanying drawings, embodiments of the present disclosure will be described in detail so that those skilled in the art can easily implement the present disclosure.

However, the present disclosure may be implemented in several different forms and is not limited to the embodiments described herein. In order to clearly illustrate the present disclosure, components not related to the description are omitted, and similar components are denoted by like reference numerals throughout the specification.

In this specification, redundant descriptions of the same components are omitted.

It will be understood that, when an element is referred to as being "connected" or "coupled" to another element, the element can be directly connected or coupled to the other element and an intervening element may also be present therebetween. In contrast, in this specification, it will be understood that, when an element is referred to as being "directly connected" or "directly coupled" to another element, there are no intervening elements present therebetween.

The terminology used herein is merely for the purpose of describing particular embodiments, and is not intended to limit the scope of the present disclosure.

In addition, as used herein, a singular form may encompass the plural form unless context dictates otherwise.

In this specification, it will be further understood that the terms "comprise", "have", etc., specify the presence of stated features, integers, steps, operations, elements, components, or combinations thereof, but do not preclude the presence or addition of one or more other features, integers, steps, operations, elements, components, or combinations thereof.

Furthermore, in this specification, the term "and/or" includes a combination of a plurality of related listed items or any of the plurality of related listed items. In this specification, "A or B" may include "A", "B", or "both A and B.".

FIG. 1 illustrates a laundry treatment apparatus 1 according to an embodiment of the present disclosure. According to an embodiment of the present disclosure, the laundry treatment apparatus 1 includes a first treatment apparatus 10, a second treatment apparatus 20, and a control panel 200.

In the description of the present disclosure, forward direction (+X), a backward direction (−X), a first lateral direction (+Y), a second lateral direction (−Y), an upward direction (+Z), and a downward direction (−Z) of the components may be defined on the same basis. For example, the forward and backward directions (+X and −X) of the first treatment apparatus 10 may be identically defined to the forward and backward directions of each of the second treatment apparatus 20 and the control panel 200, and the lateral direction (Y) and the upward and downward direction may also be defined in the same manner.

The first treatment apparatus 10 and the second treatment apparatus 20 may be embodied as various kinds of apparatuses configured to treat laundry, such as a washing machine configured to wash laundry and/or a dryer configured to dry laundry. The first treatment apparatus 10 may be a washing machine, and the second treatment apparatus 20 may be a dryer. Both the first treatment apparatus 10 and the second treatment apparatus 20 may be a washing machine or a dryer, or the first treatment apparatus 10 may be a dryer, and the second treatment apparatus 20 may be a washing machine. Each of the first treatment apparatus 10 and the second treatment apparatus 20 may be any of various kinds of apparatuses configured to treat laundry.

In an embodiment, the first treatment apparatus 10, which is positioned at a lower level, may be embodied as a washing machine configured to wash laundry. The first treatment apparatus 10 may be provided therein with a first drum 12 and a tub 14, which receive laundry therein. The first drum 12 provided in the first treatment apparatus 10 may be rotatably provided in the tub 14. The second treatment apparatus 20 may be positioned on the first treatment apparatus 10. The first treatment apparatus 10 may support the second treatment apparatus 20. The second treatment apparatus 20 may be embodied as a dryer configured to dry laundry. The second treatment apparatus 20 may be provided with a first drum 12 and a tub 14.

The first treatment apparatus 10 may include a first cabinet 110 defining the appearance thereof. The first cabinet 110 may be provided at the front side thereof with a first front panel 112. The first front panel 112 may include a laundry port communicating with the first drum 12. The laundry port may be opened and closed by a first cabinet door 17. The first drum 12 of the first treatment apparatus 10 according to an embodiment may have a rotational axis parallel to the forward and backward directions (+X and −Y).

The first treatment apparatus 10 may be provided with a first left panel 115 in one lateral direction (+Y). The first treatment apparatus 10 may be provided with a first right panel 116 (see FIG. 2) in the opposite direction (−Y). The first treatment apparatus 10 may be provided at the rear side thereof with a first rear panel (not shown). The first treatment apparatus 10 may be provided at an upper side thereof with a first upper panel (not shown). The first treatment apparatus 10 may be provided at the lower side thereof with a first lower panel (not shown).

The first front panel 112, the first lateral panel 115, the first rear panel (not shown), the first upper panel 119, and the first lower panel (not shown) may be combined with one another to form the first cabinet 100, and may be coupled to one another. The first cabinet 110 may define therein a space in which inner components constituting the first treatment apparatus 10 are received.

The first treatment apparatus 10 may be constructed such that laundry and the like to be treated is introduced into the first cabinet 110 through the laundry port so as to be received in the first drum 12, and may perform a treatment process.

The first front panel 112 may be provided with a detergent opening into which a detergent storage unit 16 is inserted. In the laundry treatment apparatus 1 according to an embodiment, the first treatment apparatus 10 may be installed on a floor, and the detergent storage unit 16 may be positioned higher than the laundry port in the first treatment apparatus 10. The detergent storage unit 16 may be positioned between the laundry port in the first treatment apparatus 10 and the control panel 200. In other words, the detergent storage unit 16 may be positioned higher than the laundry port in the first treatment apparatus 10 but lower than the control panel 200. The detergent storage unit 16 may be pushed into and pulled out of the first cabinet 110 by a user. For example, a user may separate the detergent storage unit 16 from the first cabinet 110, may put detergent into the detergent storage unit 16, and may push the detergent storage unit 16 into the first cabinet 110.

In an embodiment, the first front panel 112 may have a filter opening into which a filter unit 18 configured to collect foreign substances from washing water is inserted, and the filter unit 18 is inserted into the filter opening. The filter unit 18 may be provided at one lateral side of a lower portion of the first front panel 112. The filter unit 18 may be introduced into the first cabinet 110 through the filter opening, and may be connected to a washing water path through which washing water is discharged from the tub 14. The filter unit 18 is capable of filtering foreign substances from the washing water discharged from the tub 14 after completion of a washing operation. The function of the filter unit 18 is not necessarily limited to the filtering function for washing water. The filter unit 18 may be configured to filter foreign substances from various objects. For example, the filter unit 18 may be configured to filter foreign substances from washing water required to perform a washing operation before initiation of the washing operation.

A user may push or pull the filter unit 18 into or out of the first cabinet 110. The filter unit 18, which has been taken out of the first cabinet 100, may be washed and reused or may be replaced. The filter unit 18 may be put into and taken out of the filter opening with a higher frequency, compared to the detergent storage unit 16. Accordingly, in an embodiment of the present disclosure, the detergent opening, into which the detergent storage unit 16 which is put into and taken out of the detergent opening with a lower frequency is inserted, may be disposed at an upper side of the first front panel 112. In addition, the filter opening, into which the filter unit 18 which is put into and taken out of the filter opening with a higher frequency is inserted, may be disposed at a lower side of the first front panel 112. Consequently, it is possible to realize the first front panel 112 which has excellent convenience in use and availability of a space.

Furthermore, the washing water discharge path, which is connected to the tub 14 in the first cabinet 10, may be positioned at a lower side in the first cabinet 110 so as to allow easy discharge of washing water. In an embodiment of the present disclosure, the filter unit 18 may be provided at the lower side of the first cabinet 110 so as to be efficiently connected to the washing water discharge path.

The first treatment apparatus 10 may be provided with a first apparatus controller 19. The first apparatus controller 19 is a component configured to control various components constituting the first treatment apparatus 10. The first apparatus controller 19 may be disposed in the first cabinet 110. The first apparatus controller 19 may include a circuit board and electrical components mounted on the circuit board. In an embodiment, the first apparatus controller 19 may check information in a memory, corresponding to a manipulation signal received from the control panel 200, and may perform control corresponding to the manipulation signal. The first apparatus controller 19 may transmit the state of the first treatment apparatus 10 to the control panel 200.

The second treatment apparatus 20 may include a second cabinet 120 defining the appearance thereof. The second cabinet 120 may include a second front panel 122 provided at a front side thereof. The second front panel 122 may be provided with a laundry port communicating with the second drum 22. The laundry port may be opened and closed by a second cabinet door 27.

The second treatment apparatus 20 may be provided with a second left panel 125 in one lateral direction (+Y). The second treatment apparatus 20 may be provided with a second right panel 126 (see FIG. 2) in the opposite lateral direction (−Y). The second treatment apparatus 20 may be provided at a rear side thereof with a second rear panel (not shown). The second treatment apparatus 20 may be provided at an upper side thereof with a second upper panel 127. The second treatment apparatus 20 may be provided at a lower side thereof with a base (not shown).

The second front panel 122, the second lateral panel 125, the second rear panel (not shown), the second upper panel 127, and the base 500 may be combined with one another to form the second cabinet 120, and may be coupled to one another. The second cabinet 120 may define a space in which electrical components constituting the second treatment apparatus 20 are received together with the second drum 22.

Laundry and the like to be treated may be introduced into the second cabinet 120 through the laundry port of the second treatment apparatus 20, and may then be received in the second drum 22. The laundry received in the second drum 22 may be subjected to treatment operations, such as washing, drying and the like, by the second treatment apparatus 20.

The second treatment apparatus 20 according to an embodiment may be constructed such that the laundry port is provided at the second front panel 122 together with the second cabinet door 27. The second drum 22 received in the second treatment apparatus 20 may have a rotational axis parallel to the forward and backward direction X.

The second treatment apparatus 20 may be disposed on the first treatment apparatus 10. In an embodiment, the lower portion of the first treatment apparatus 10 may be coupled to the upper portion of the second treatment apparatus 20. The upper portion of the first treatment apparatus 10 may be constructed so as to support the second treatment apparatus 20. For example, the first upper panel (not shown) of the first treatment apparatus 10 may be constructed so as to directly and indirectly support the base 500 of the second treatment apparatus 20.

The second treatment apparatus 20 may be provided with a second apparatus controller 29. The second apparatus controller 29 is a component configured to control various components constituting the second treatment apparatus 20. The second apparatus controller 29 may be disposed in the second cabinet 120. The second apparatus controller 29 may include a circuit board and electrical components mounted on the circuit board. In an embodiment, the second apparatus controller 29 may check information in a memory, corresponding to a manipulation signal received from the control panel 200, and may perform control corresponding to the manipulation signal. The second apparatus controller 29 may transmit the state of the second treatment apparatus 20 to the control panel 200.

The control panel 200 may be disposed between the first front panel 112 and the second front panel 122. Since the control panel 200 is provided between the first front panel 112 and the second front panel 122 at a level almost corresponding to a user's waist, it is possible to assure a height convenient to manipulate the control panel. The control panel 200 may be connected to at least one of the first treatment apparatus 10 or the second treatment apparatus 20 in a signal communication manner. In an embodiment, the control panel 200 may be connected to the first treatment apparatus 10 and the second treatment apparatus 200 in a signal communication manner. In an embodiment, the control panel 200 may be connected to the first apparatus controller 19 and/or the second treatment apparatus 20 in a signal communication manner. A user interface (UI) may be displayed on the front surface of the control panel 200. A user may control the first treatment apparatus 10 and/or the second treatment apparatus 20 through the control panel 200.

The laundry treatment apparatus 1 may be provided at the rear side thereof with a rear bracket 300. The rear bracket 300 may be coupled both to the first treatment apparatus 10 and to the second treatment apparatus 20. The rear bracket 300 may be disposed at an upper portion of a rear side of the first treatment apparatus 10 and at a lower portion of a rear side of the second treatment apparatus 20. The rear bracket 300 may be provided with a handle for a transporting person. A transporting person may easily move the laundry treatment apparatus 1 using the handle formed at the rear bracket 300.

Figure 2:
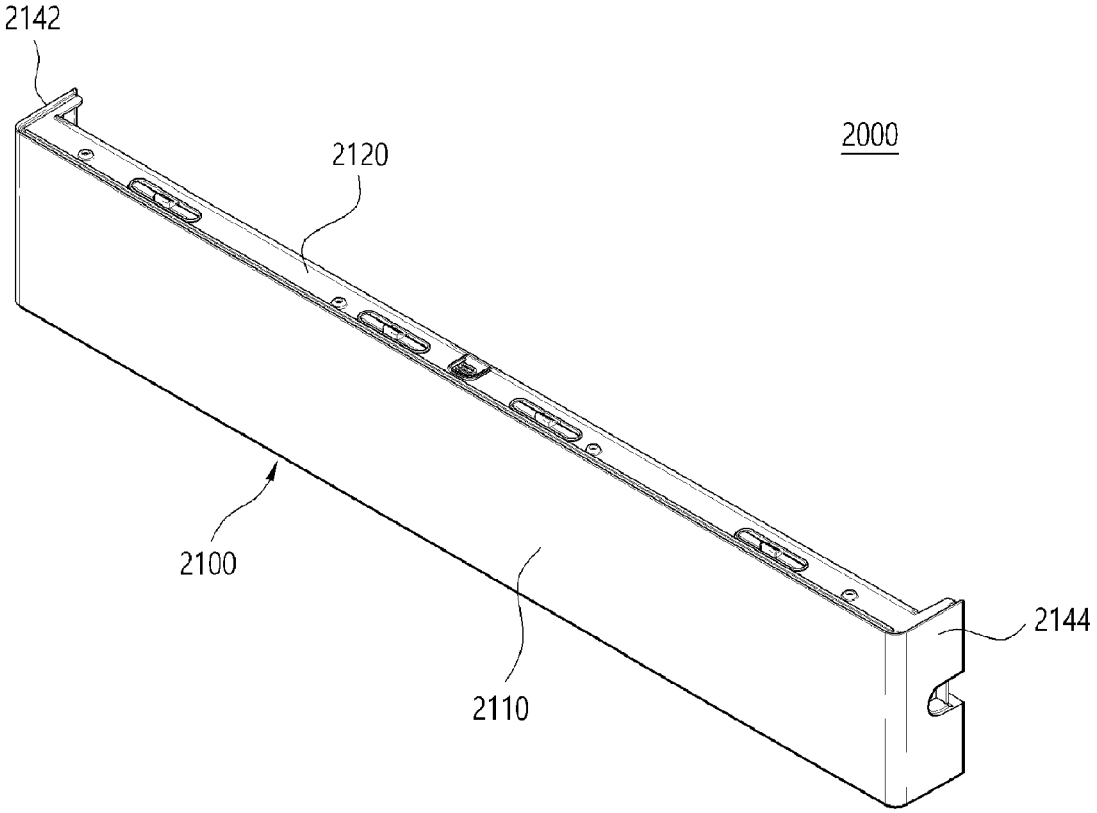
FIG. 2 is a front perspective view of a control panel according to an embodiment of the present disclosure.

FIG. 2 is a front perspective view of the control panel according to an embodiment of the present disclosure. The control panel will now be described with reference to FIG. 2.

The control panel 2000 may include a cover panel 2100. An electrical component module 3000 (see FIG. 3) may be positioned at the rear side of the cover panel 2100. The cover panel 2100 may include a front surface portion 2110, an upper surface portion 2120, a lower surface portion 2130 (see FIG. 9), a first lateral surface portion 2142, and a second lateral surface portion 2144. The front surface portion 2110 may define the appearance of the cover panel 2100. The upper surface portion 2120 may extend backwards from the upper surface of the front surface portion 2110. The first lateral surface portion 2142 may extend backwards from a first lateral surface of the front surface portion 2110. The second lateral surface portion 2144 may extend backwards from a second lateral surface of the front surface portion 2110.

Figure 3:
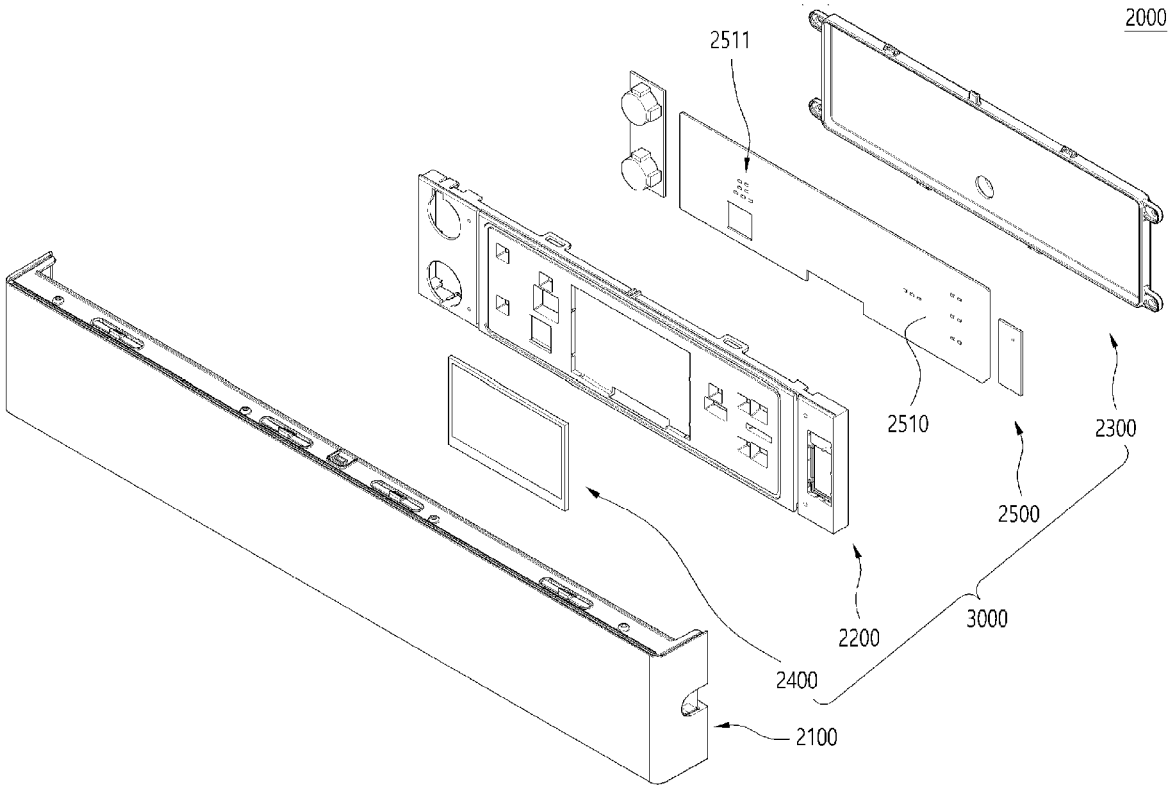
FIG. 3 is an exploded perspective view of the control panel according to an embodiment of the present disclosure.

FIG. 3 is an exploded perspective view of the control panel according to an embodiment of the present disclosure.

The control panel 2000 may include the cover panel 2100 and the electrical component module 3000. The electrical component module 3000 may be disposed behind the cover panel 2100 and coupled to the cover panel 2100. The electrical component module 3000 may include a supporter 2200, a sealing cover 2300, a flat display 2400, and a circuit board 2500.

The supporter 2200 is a component configured to support the flat display 2400. The supporter 2200 may have a panel-shaped front surface. The supporter 2200 may be coupled both to the upper surface portion 2120 and to the lower surface portion 2130 of the cover panel 2100.

The flat display 2400 may be positioned on the front surface of the supporter 2200. The flat display 2400 may be supported by the supporter 2200. The flat display 2400 may be positioned between the cover panel 2100 and the supporter 2200. In the description of the present disclosure, the flat display 2400 may refer to a thin display, and may be provided as any of various forms such as LCDs, PDPs, AMLCLs, PMLCDs, OLEDs and LEDS.

The sealing cover 2300 may be positioned behind the supporter 2200, and may be coupled to the supporter 2200. The sealing cover 2300 may cover the circuit board 2500. The sealing cover 2300 may be positioned behind the circuit board 2500. The circuit board 2500 may be positioned in the first space 2390 (see FIG. 21) defined between the sealing cover 2300 and the supporter 2200.

The circuit board 2500 may include a plurality of circuit boards. Some of the circuit boards 2500 may be covered by the cover panel 2100 so as to be prevented from contacting external air. The circuit boards 2500 may include a circuit board for a speaker to be described later, a circuit board 2510 for the flat display 2400 and a touch button 2511 functioning as an input button, and a circuit board for a communication module. The circuit board for the flat display 2400 may be electrically connected to the flat display 2400 so as to transmit a signal to the flat display 2400. Furthermore, the circuit board for the flat display 2400 may receive an input signal of a user through the user interface. In an embodiment, the circuit board for the flat display 2400 may be covered by the sealing cover 2300 so as to be prevented from contacting external air.

The circuit board 2510 for the flat display 2400 may be provided with the touch button 2511. The touch button 2511 may be composed of a pair of components, that is, a light-emitting member and a touch sensor. The light-emitting member may display whether or not the corresponding touch sensor is activated. For example, when the touch sensor is activated, the light-emitting member may emit light. The light-emitting device may be embodied as an LED. The supporter 2200 may concentrate the light diffused from the light-emitting device on a certain location. In an embodiment, the supporter 2200 may include at least one sensor hole 2216 formed therein. The sensor hole 2116 may be formed at a location corresponding to the location of the touch button 2511. The sensor hole 2116 may form a blocking wall which extends from the periphery of the hole forwards or backwards. The blocking wall may prevent the light emitted from the light-emitting device from diffusing around the touch button 2511. Since the circuit board 2510 is positioned behind the supporter 2200, it is possible to prevent diffusion of the light of the touch button 2511.

Figure 4:
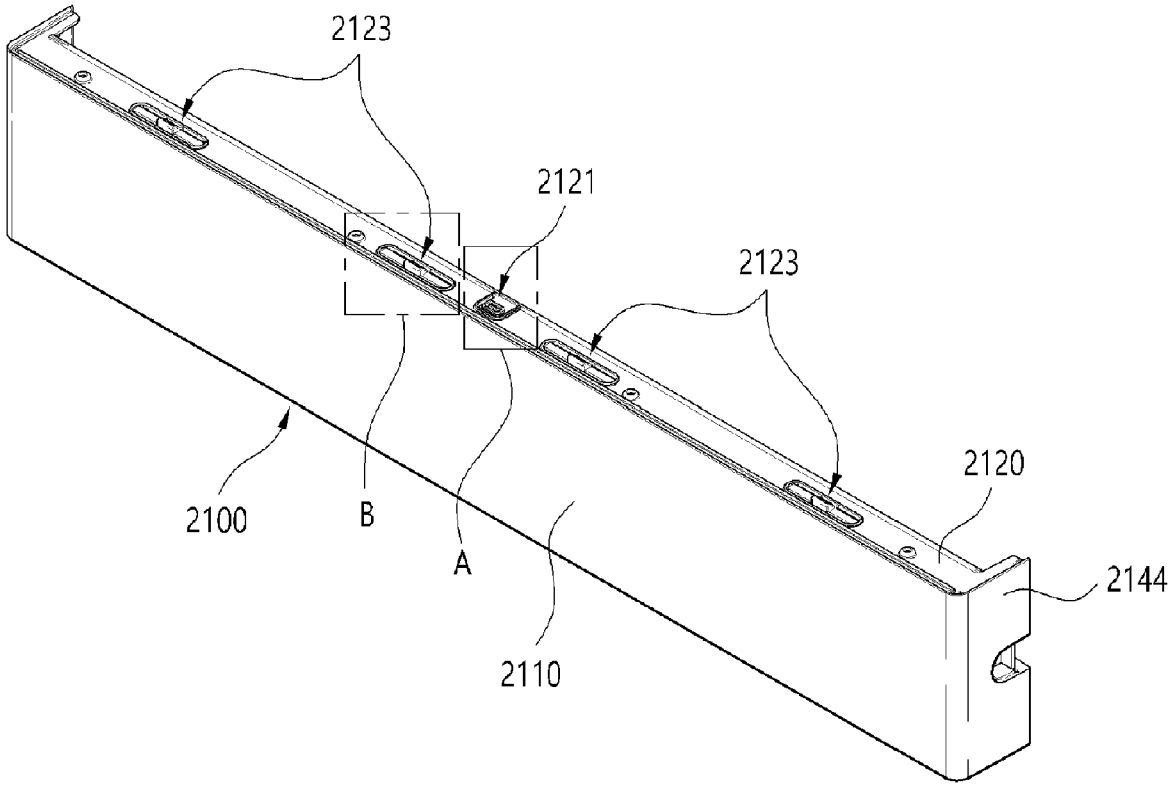
FIG. 4 is a perspective view of a cover panel constituting the control panel according to an embodiment of the present disclosure.

FIG. 4 is a front perspective view of the cover panel constituting the control panel according to an embodiment of the present disclosure. The cover panel 2100 will now be described with reference to FIG. 4.

The upper surface portion 2120 of the cover panel 2100 may be provided with elements for coupling with other components. In an embodiment, an electrical component module coupler 2121 may be formed in the center of the upper surface portion 2120. The electrical component module coupler 2121 may be a component configured to be coupled to the electrical component module 3000. In an embodiment, a plurality of second front panel couplers 2123 may be formed at the upper surface portion 2120. The second front panel couplers 2123 may project in an outward direction of the cover panel 2100. The second front panel couplers 2123 may project in an upward direction of the cover panel 2100.

Figure 5:
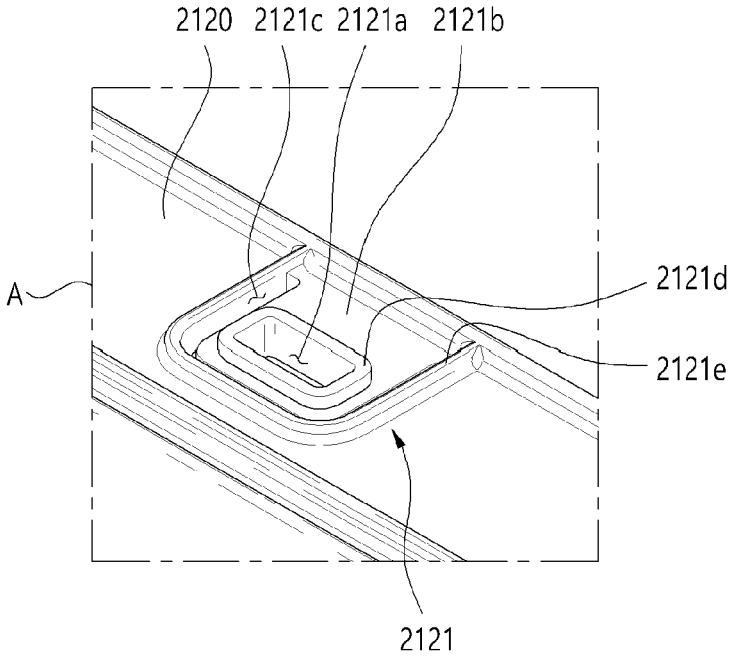
FIG. 5 is a fragmentary enlarged view of portion A in FIG. 4.
Figure 6:
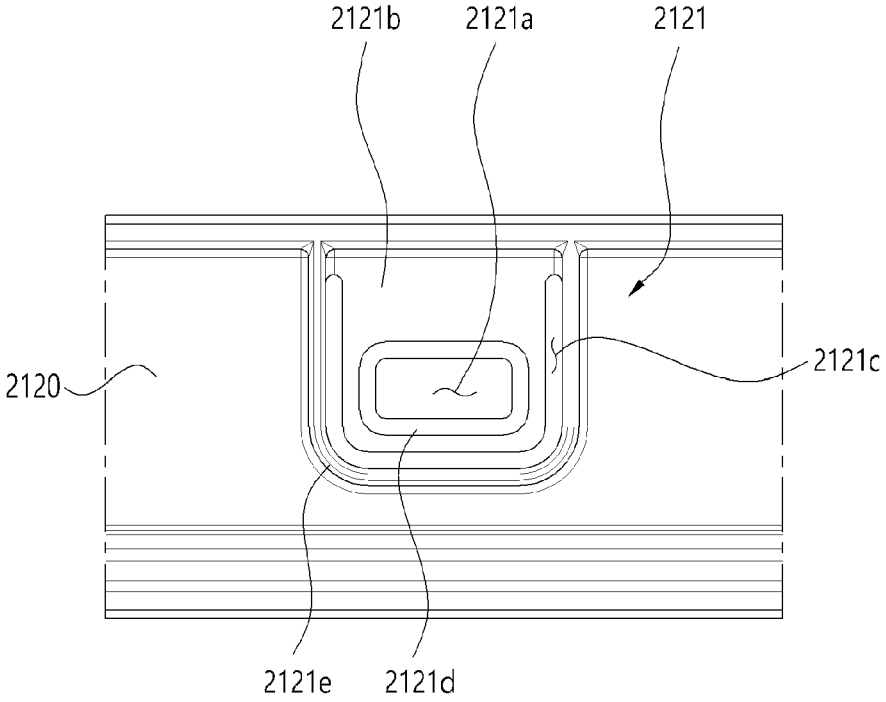
FIG. 6 is a plan view of an electrical component module coupler according to an embodiment of the present disclosure.

FIG. 5 is a fragmentary enlarged view of region A in FIG. 4. FIG. 6 is a plan view of the electrical component module coupler according to an embodiment of the present disclosure. The electrical component module coupler 2121 will now be described with reference to FIGS. 5 and 6.

The electrical component module coupler 2121 may be a component configured to couple the electrical component module 3000 to the cover panel 2100. In an embodiment, the electrical component module coupler 2121 may be coupled to the sealing cover 2300. The electrical component module coupler 2121 may be formed at a location corresponding to a cover panel coupling protrusion 2321 (see FIG. 20). The electrical component module coupler 2121 may be provided with a protrusion-receiving hole 2121*a* formed therein. In an embodiment, the protrusion-receiving hole 2121*a* may constitute the electrical component module coupler 2121. The protrusion-receiving hole 2121*a* may receive therein the cover panel coupling protrusion 2321 (see FIG. 20) formed at the sealing cover 2300.

In an embodiment, a slit 2121*c* may be formed around the protrusion-receiving hole 2121*a*. The term "slit" used herein may mean an opening having a narrow width. The slit 2121*c* may be formed so as to be blind at the rear side thereof and to surround the protrusion-receiving hole 2121*a*. The protrusion-receiving hole 2121*a* and the slit 2121*c* may be spaced apart from each other by a predetermined distance. The protrusion-receiving hole 2121*a* may be formed in an elastic surface 2121*b* which has elasticity higher than other portions of the upper surface portion 2120 by virtue of the slit 2121*c*. The slit 2121*c* may extend to a location which is spaced apart from the rear surface of the upper surface portion 2120.

A reinforcing projection 2121*e* may be further formed along the outer periphery of the slit 2121*c*. A reinforcing projection 2121*d* may be further formed along the outer periphery of the protrusion-receiving hole 2121*a*.

Figure 7:
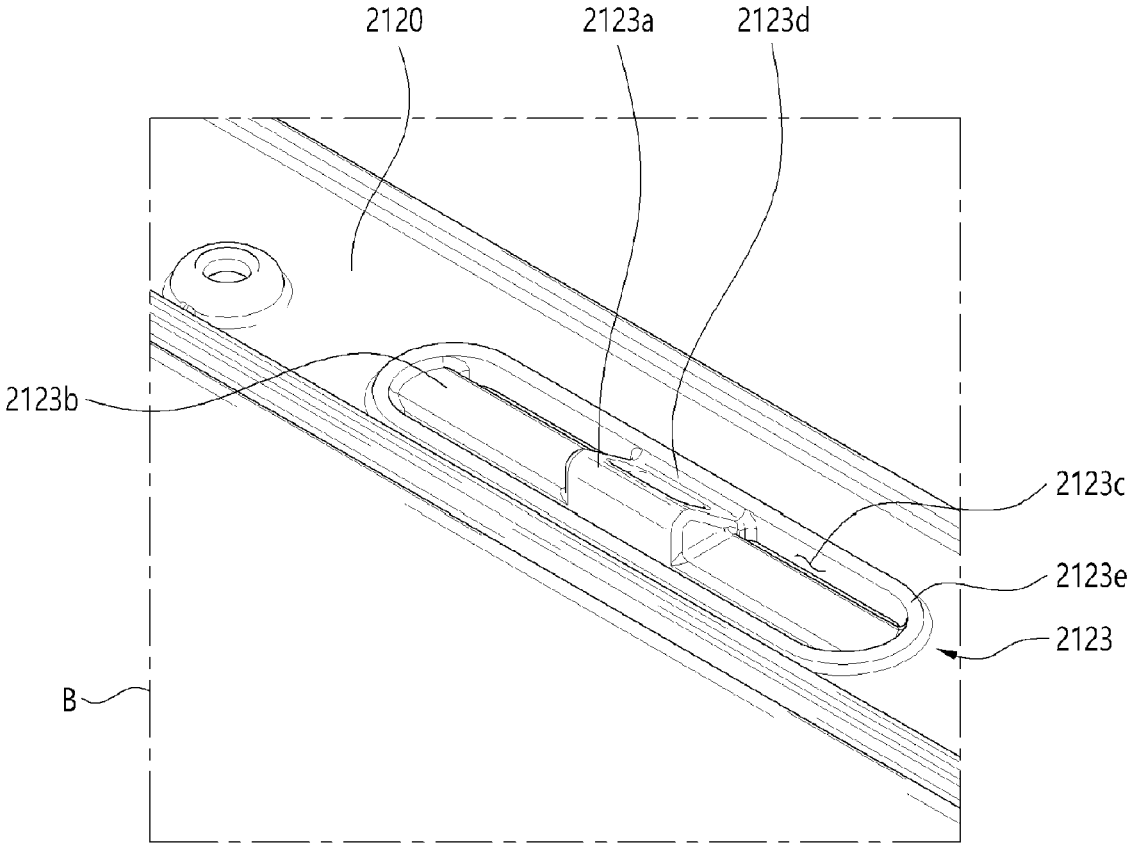
FIG. 7 is a fragmentary enlarged view of portion B in FIG. 4.
Figure 8:
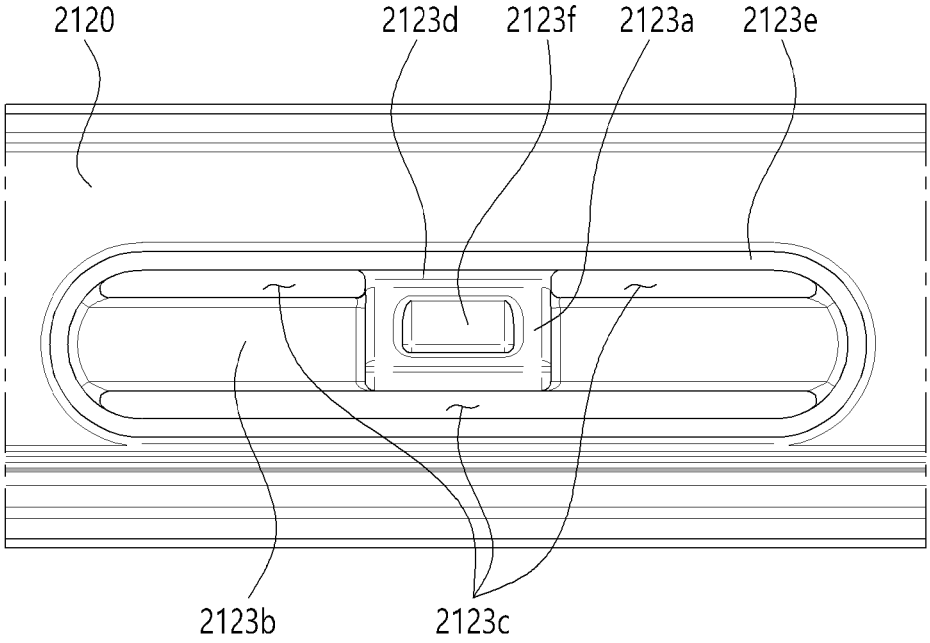
FIG. 8 is a plan view of a second front panel coupler according to an embodiment of the present disclosure.

FIG. 7 is a fragmentary enlarged view of portion B in FIG. 4. FIG. 8 is a plan view of the second front panel coupler according to an embodiment of the present disclosure. The second front panel coupler 2123 will now be described with reference to FIGS. 7 and 8. The second front panel coupler 2123 is a component configured to be coupled to the second front panel 122 of the second treatment apparatus 20. The second front panel coupler 2123 may project in an outward direction of the cover panel 2100. The second front panel coupler 2123 may include a coupling protrusion 2123*a*. The coupling protrusion 2123*a* may be inserted into a groove or a hole formed in a lower portion of the second front panel 122. The coupling protrusion 2123*a* may have a triangular shape when viewed from a lateral side. The coupling protrusion 2123*a* may be inclined upwards as the same approaches the front end thereof from the rear end thereof. The height of the front end of the coupling protrusion 2123*a* may be higher than the rear end of the coupling protrusion 2123*a*. Slits 2123*c*, which extend in rightward and leftward directions, may be formed before and behind the coupling protrusion 2123*a*. By virtue of the slits 2123*c*, an elastic surface 2123*b* has higher elasticity than other portions of the upper surface portion 2120. The coupling protrusion 2123*a* may be formed on the elastic surface 2123*b*. The outer peripheral portion of the coupling protrusion 2123*a* may project whereas the inner portion of the coupling protrusion 2123*a* may not project. In an embodiment, the coupling protrusion 2123*a* may be provided with a recessed portion 2123*f*. The coupling protrusion 2123*a* may be connected to the upper surface portion 2120 across the slit 2123*c* via a bridge 2123*d*. A reinforcing projection 2123*e* may further be formed along the outer periphery of the slits 2123*c*.

Figure 9:
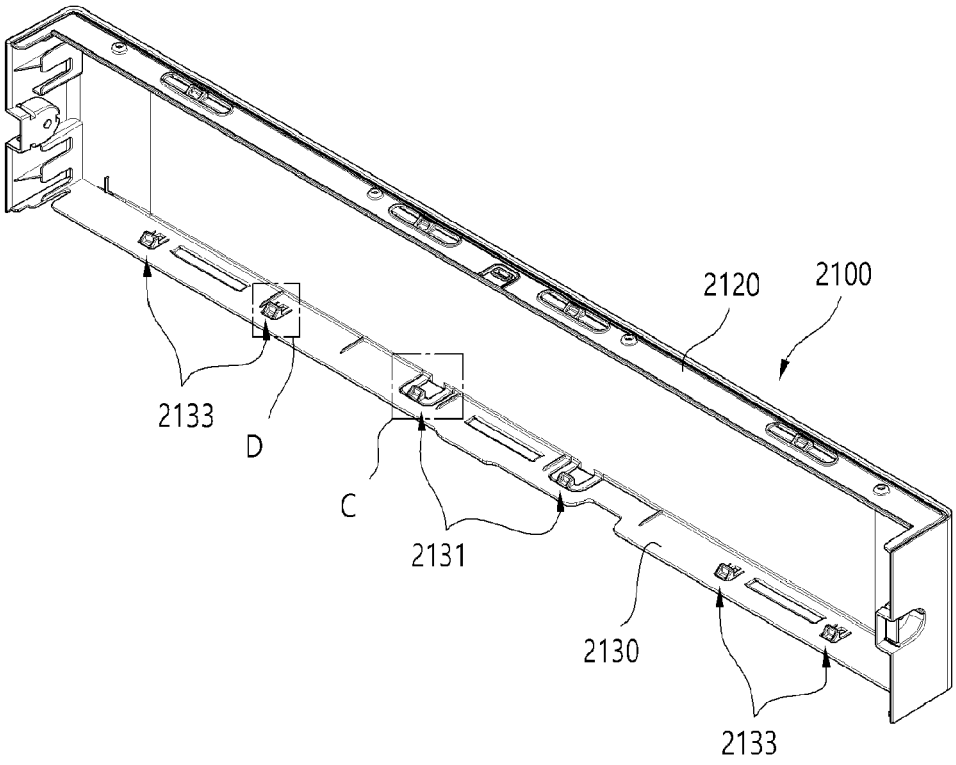
FIG. 9 is a perspective view of the cover panel according to an embodiment of the present disclosure when viewed in a downward direction from the inside of the cover panel.

FIG. 9 is a perspective view of the cover panel according to an embodiment of the present disclosure when viewed in a downward direction from the inside of the cover panel. The upper surface of the lower surface portion 2130 of the cover panel 2100 will now be described with reference to FIG. 9.

The lower surface portion 2130 of the cover panel 2100 may include a first restrainer 2131 and a second restrainer 2133. The first restrainer 2131 may project upwards (inwards) from the lower surface portion 2130. The first restrainer 2131 may be formed on the inside of the second restrainer 2133, and may include a plurality of first restrainers. The plurality of first restrainers 2131 may be symmetrically formed in the center of the cover panel 2100. The second restrainer 2133 may project upwards (inwards) from the lower surface portion 2130 of the second restrainer 2133. The second restrainer 2133 may be formed on the outer side of the first restrainer 2131, and may include a plurality of second restrainers. The plurality of second restrainers 2133 may be symmetrically formed in the center of the cover panel 2100.

Figure 10:
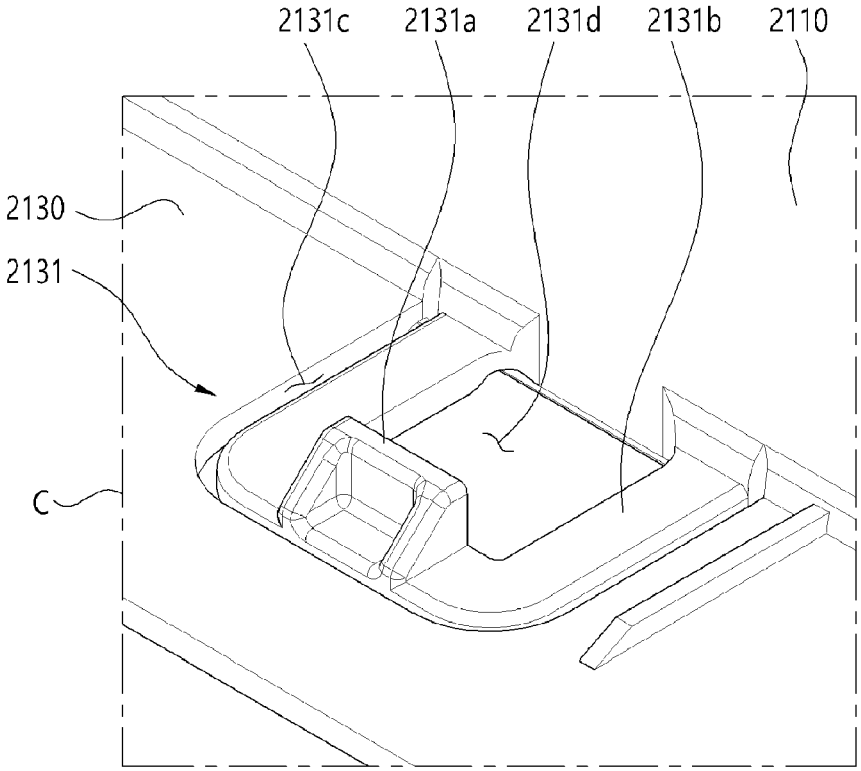
FIG. 10 is a fragmentary enlarged view of portion C in FIG. 9.

FIG. 10 is a fragmentary enlarged view of portion C in FIG. 9. The first restrainer 2131 will now be described with reference to FIG. 10.

The first restrainer 2131 may be a component configured to restrain the position of the electrical component module 3000. In an embodiment, the first restrainer 2131 may include a first restraining protrusion 2131*a*. The first restraining protrusion 2131*a* may project inwards from the upper surface portion 2120 and/or the lower surface portion 2130 of the cover panel 2100. The first restraining protrusion 2131*a* may project inwards from the lower surface portion 2130. The first restraining protrusion 2131*a* may be formed at a location corresponding to a cover panel engaging protrusion 2337 (see FIG. 20). The first restraining protrusion 2131*a* may be positioned behind the cover panel engaging protrusion 2337. The first restraining protrusion 2131*a* may come into close contact with the cover panel engaging protrusion 2337 to restrain the sealing cover 2300 at the rear side of the sealing cover 2300.

A slit 2131*c* may be formed around the first restraining protrusion 2131*a*. The slit 2131*c* may be formed so as to surround the first restraining protrusion 2131*a*. The width of the rear portion of the slit 2131*c* may be wider than the width of the first restraining protrusion 2131*a*. The slit 2131*c* may extend backwards from the front side of the upper surface portion 2120, and may extend along the rear side of the first restraining protrusion 2131*a* and then toward the front side of the upper surface portion 2120. The front ends of the slit 2131*c* may be closed. The slit 2131*c* may define an elastic surface 2131*b*. The first restraining protrusion 2131*a* may be formed on the elastic surface 2131*b*. The first restraining protrusion 2131*a* may be inclined upwards as the same approaches the front end from the rear end thereof. The height of the front end of the first restraining protrusion 2131*a* may be higher than the height of the rear end of the first restraining protrusion 2131*a*.

The first restrainer 2131 may have an opening 2131*d*. The opening 2131*d* may have a length between the front end of the first restraining protrusion 2131*a* and the front side of the upper surface portion 2120, and a width wider than the first restraining protrusion 2131*a*. The opening 2131*d* may have a width sufficient to receive the cover panel engaging protrusion 2337. The cover panel engaging protrusion 2337 may be received in the opening 2131*d*.

Figure 11:
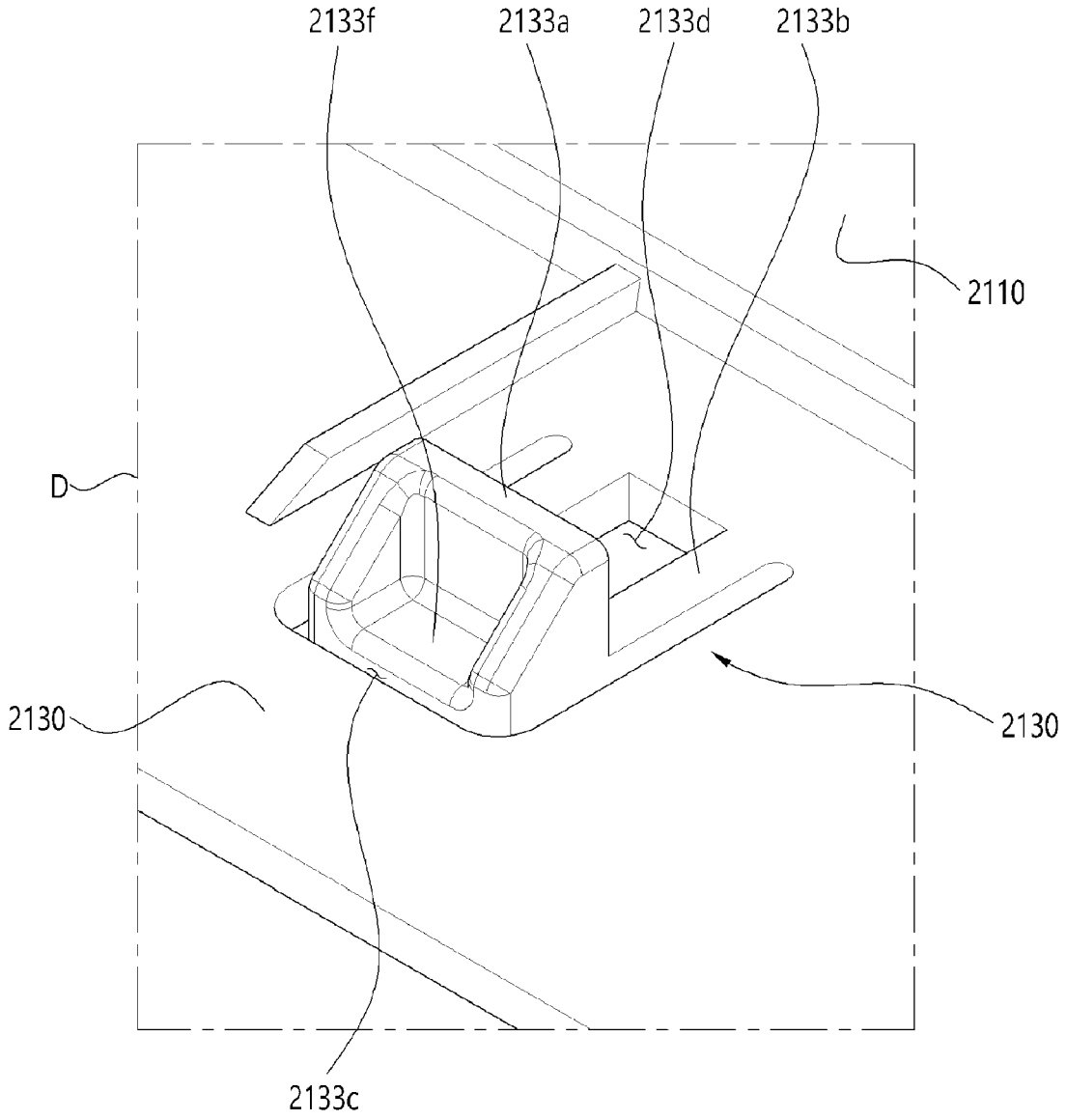
FIG. 11 is a fragmentary enlarged view of portion D in FIG. 9.

FIG. 11 is a fragmentary enlarged view of portion D in FIG. 9. The second restrainer 2133 will now be described with reference to FIG. 11.

The second restrainer 2133 may be a component configured to restrain the position of the electrical component module 3000. In an embodiment, the second restrainer 2133 may include a second restraining protrusion 2133*a*. The second restraining protrusion 2133*a* may project inwards from the upper surface portion 2120 and/or the lower surface portion 2130 of the cover panel 2100. In an embodiment, the second restraining protrusion 2133*a* may project inwards (upwards) from the lower surface portion 2130. The second restraining protrusion 2133*a* may support the rear side of the supporter 2200, and may restrain the position of the supporter 2200. A first coupling groove 2232 (see FIG. 17) may be formed at a location of the supporter 2200 corresponding to the second restraining protrusion 2133*a*. The second restraining protrusion 2133*a* may include a plurality of second restraining protrusions, and the first coupling groove 2232 may also include a plurality of first coupling grooves corresponding to the plurality of second restraining protrusions 2133*a*. At least one of the plurality of first coupling grooves 2232 may have the same width as the width of the second restraining protrusion 2133*a*. Here, the term "same" may a concept meaning substantially identical including tolerance. The second restraining protrusion 2133*a* may be inserted into the first coupling groove 2232 so as to restrain the position of the supporter 2200. The second restraining protrusion 2133*a* may restrict movement of the supporter 2200 in forward and backward directions and in rightward and leftward directions.

A slit 2133*c* may be formed around the second restraining protrusion 2133*a*. The slit 2133*c* may be formed so as to surround the second restraining protrusion 2133*a*. The width of the rear end of the slit 2133*c* may be identical to the width of the second restraining protrusion 2133*a*. The slit 2133*c* may extend backwards from a location, which is spaced apart from the front side of the upper surface portion 2120 by a predetermined distance, and may extend along the rear side of the second restraining protrusion 2133*a* to a location, which is spaced apart from the front side of the upper surface portion 2120 by a predetermined distance. The second restraining protrusion 2133*a* may be inclined upwards as the same approaches the front end from the rear end thereof. The height of the front end of the second restraining protrusion 2133*a* may be higher than the height of the rear end of the second restraining protrusion 2133*a*.

The second restrainer 2133 may have an opening 2133*d*. The opening 2133*d* may have a length corresponding to the length that the slit 2133*c* extends from the front end of the second restraining protrusion 2133*a*, and a width similar to the width of the second restraining protrusion 2133*a*.

Both the second restrainer 2133 and the electrical component module coupler 2121 may be formed at one of the upper surface portion 2120 and the lower surface portion 2130. In an embodiment, the second restrainer 2133 and the electrical component module coupler 2121 may be formed at the upper surface portion 2120.

Figure 12:
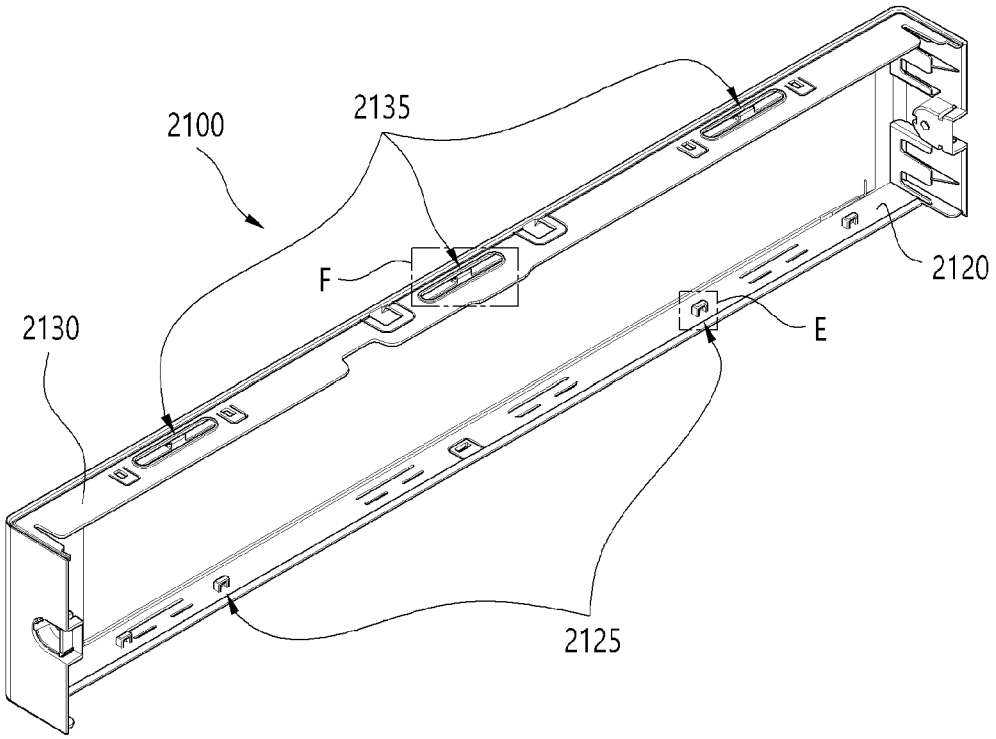
FIG. 12 is a perspective view of the cover panel according to an embodiment of the present disclosure when viewed in an upward direction from the inside of the cover panel.

FIG. 12 is a perspective view of the cover panel according to an embodiment of the present disclosure when viewed in an upward direction from the inside of the cover panel.

The upper surface portion 2120 of the cover panel 2100 may be provided with a third restrainer 2125. The third restrainer 2125 may project downwards (inwards) from the upper surface portion 2120. In an embodiment, the lower surface portion 2130 of the cover panel 2100 may be provided with a first front panel coupler 2135. The first front panel coupler 2135 may project in an outward direction of the cover panel 2100. The first front panel coupler 2135 may project in a downward direction of the cover panel 2100.

Figure 13:
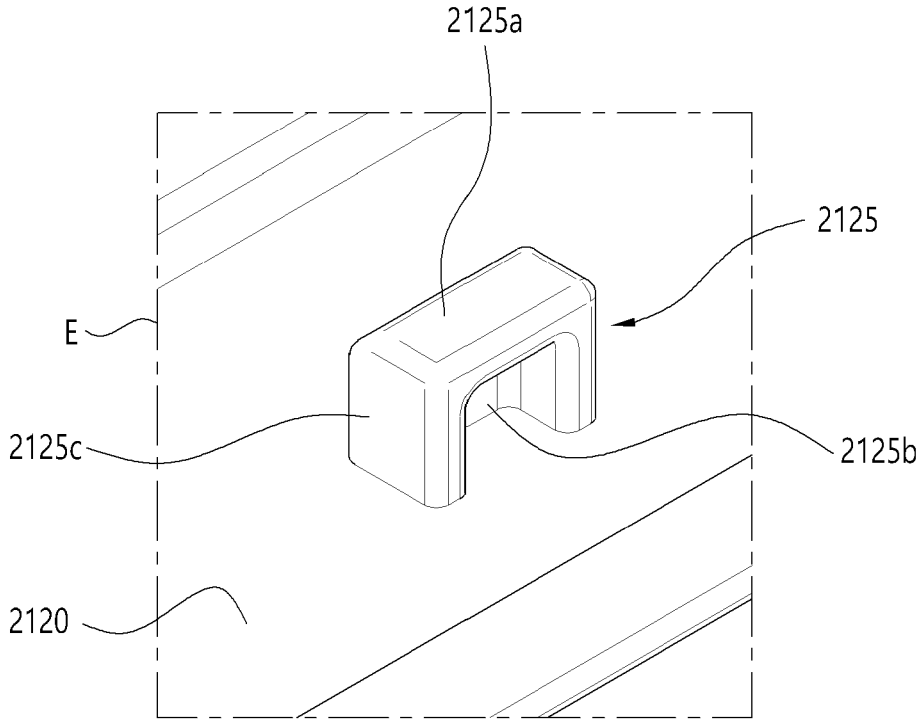
FIG. 13 is a fragmentary enlarged view of portion E in FIG. 12.

FIG. 13 is a fragmentary enlarged view of portion E in FIG. 12.

The third restrainer 2125 may be a component configured to restrain the position of the electrical component module 3000. In an embodiment, the third restrainer 2125 may include a third restraining protrusion 2125*a*. The third restraining protrusion 2125*a* may project inwards from the upper surface portion 2120 and/or the lower surface portion 2130 of the cover panel 2100. In an embodiment, the third restraining protrusion 2125*a* may project inwards (downwards) from the lower surface portion 2130. The third restraining protrusion 2125*a* may support the rear side of the supporter 2200, and may restrain the position of the supporter 2200. In an embodiment, the third restraining protrusion 2125*a* may have a rectangular shape when viewed from a lateral side. A second coupling groove 2222 (see FIG. 17) may be formed at a location of the supporter 2200 corresponding to the third restraining protrusion 2125*a*. The third restraining protrusion 2125*a* may include a plurality of third restraining protrusions, and the second coupling groove 2222 may also include a plurality of third coupling grooves, which correspond to the plurality of third restraining protrusions 2125*a*. At least one of the plurality of second coupling grooves 2222 may have the same width as the width of the third restraining protrusion 2125*a*. Here, the term "same" may be a concept meaning substantially identical including a tolerance. The third restraining protrusion 2125*a* may be inserted into the second coupling groove 2222 so as to restrain the position of the supporter 2200. The third restraining protrusion 2125*a* may restrain the position of the supporter 2200 in forward and backward directions and in rightward and leftward directions.

Figure 14:
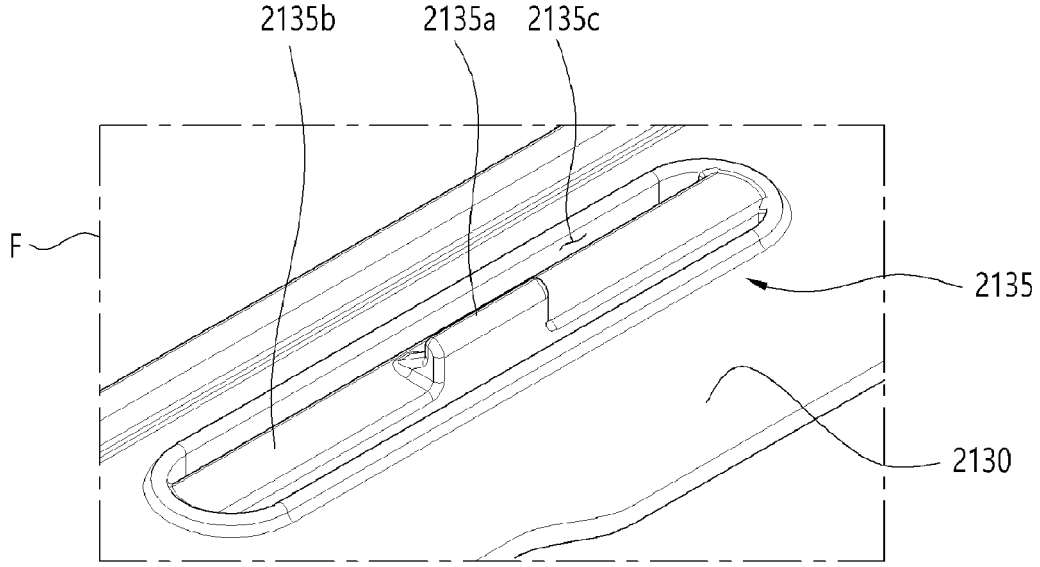
FIG. 14 is a fragmentary enlarged view of portion F in FIG. 12.
Figure 15:
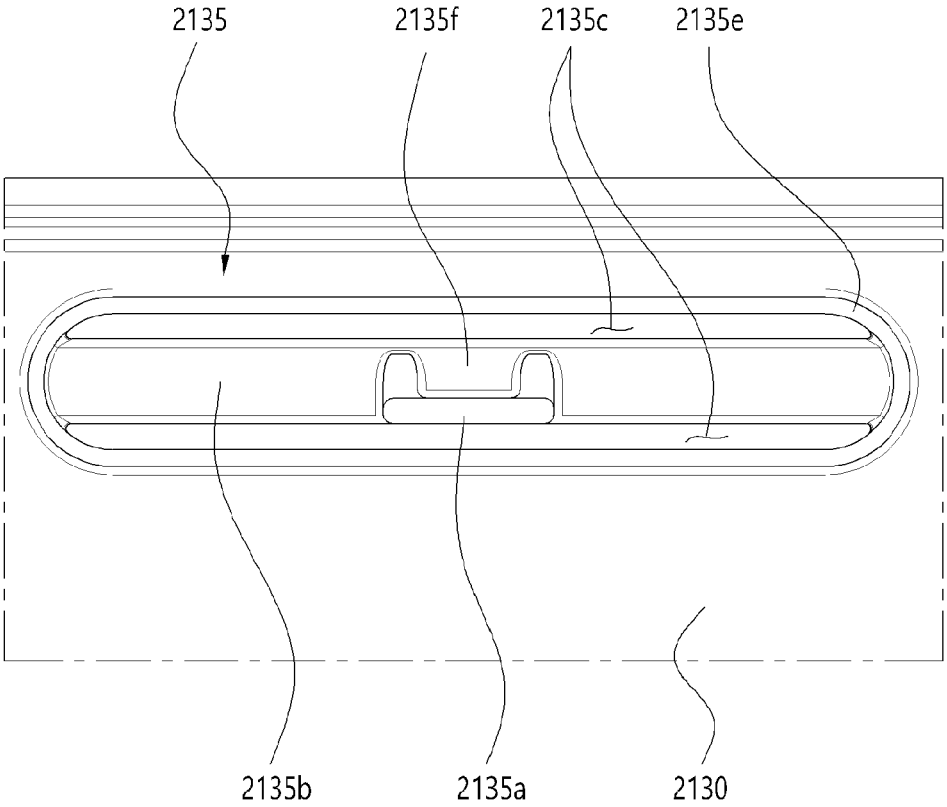
FIG. 15 is a bottom view of a first front panel coupler according to an embodiment of the present disclosure.

FIG. 14 is a fragmentary enlarged view of portion F in FIG. 12. FIG. 15 is a bottom view of the first front panel coupler according to an embodiment of the present disclosure. The first front panel coupler 2135 will now be described with reference to FIGS. 14 and 15.

The first front panel coupler 2135 may be a component to be coupled to the first front panel 112 of the first treatment apparatus 10. The first front panel coupler 2135 may project in an outward direction of the cover panel 2100. The first front panel coupler 2135 may include a coupling protrusion 2135*a*. The coupling protrusion 2135*a* may be inserted into a groove or a hole formed in the upper portion of the first front panel 112. The coupling protrusion 2135 may be inclined upwards as the same approaches the rear end from the front end thereof. The height of the rear end of the coupling protrusion 2135*a* may be higher than the height of the front end of the coupling protrusion 2135*a*. Slits 2135*c*, which extend in rightward and leftward directions, may be formed before and behind the coupling protrusion 2135*a*. By virtue of the slits 2135*c*, an elastic surface 2135*b*, which has elasticity higher than other portions of the lower surface portion 2130, may be formed. The coupling protrusion 2136*a* may be formed on the elastic surface 2135*b*. The outer peripheral portion of the coupling protrusion 2135*a* may project whereas the inner portion of the coupling protrusion 2135*a* may not project. In an embodiment, the coupling protrusion 2135*a* may be provided with a recessed portion 2135*f*. A reinforcing projection 2135*c* may further be formed along the outer periphery of the slits 2135*c*.

Figure 16:
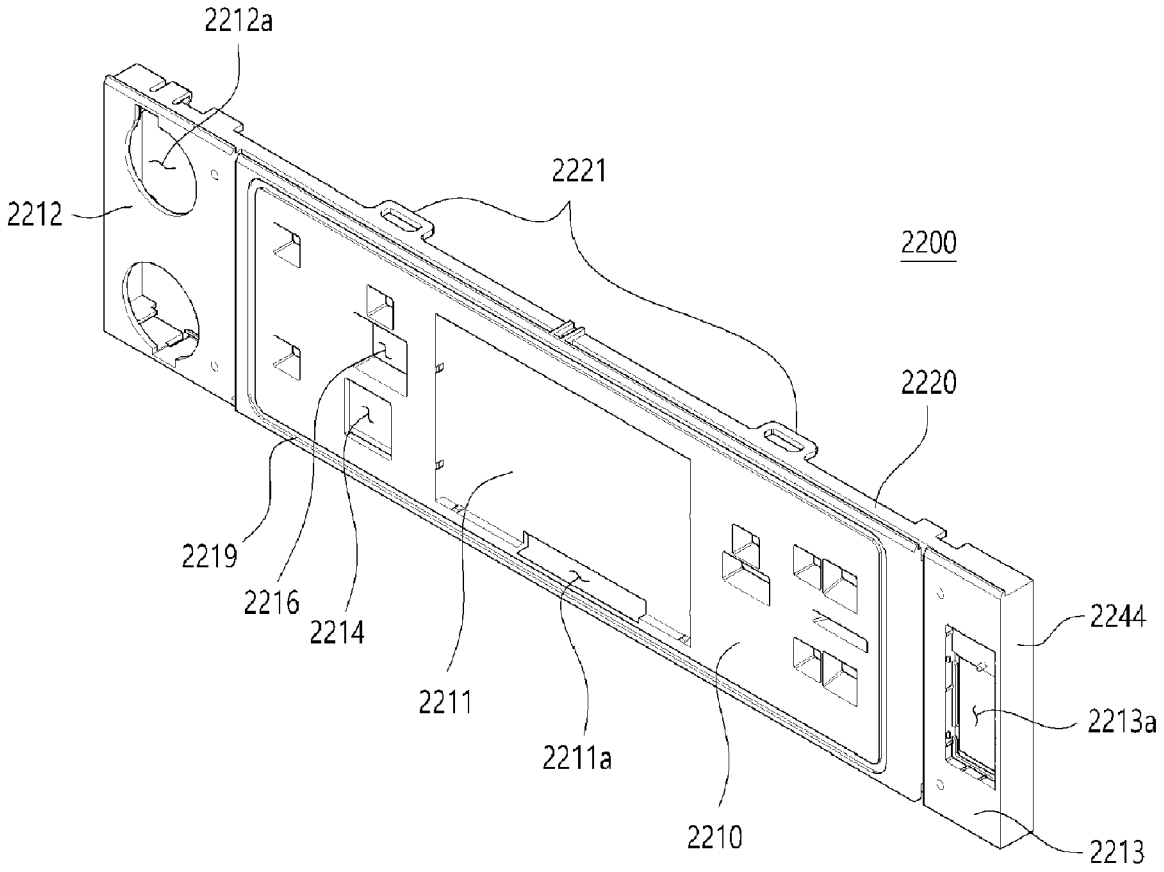
FIG. 16 is a front perspective view of a supporter constituting the control panel according to an embodiment of the present disclosure.
Figure 17:
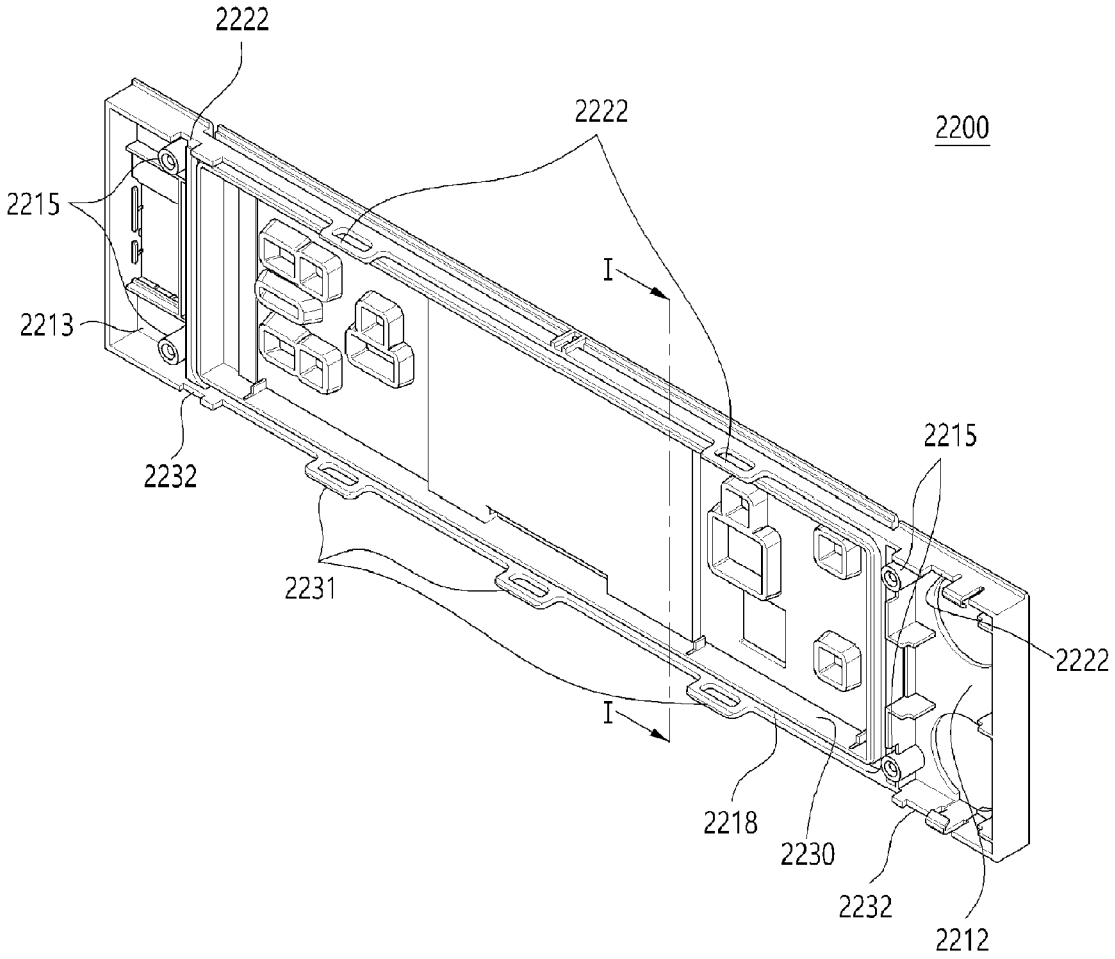
FIG. 17 is a rear perspective view of the supporter constituting the control panel according to an embodiment of the present disclosure.
Figure 18:
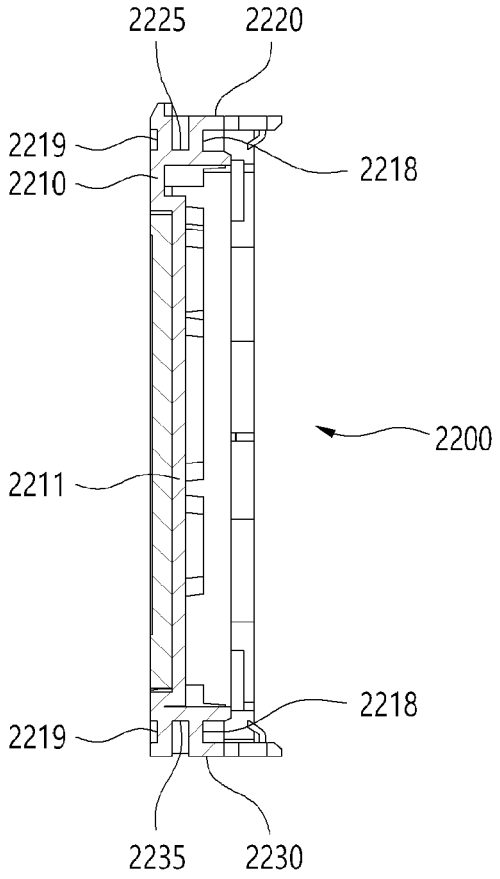
FIG. 18 is a cross-sectional view taken along cross-sectional line I-I in FIG. 17.

FIG. 16 is a front perspective view of the support constituting the control panel according to an embodiment of the present disclosure. FIG. 17 is a rear perspective view of the support constituting the control panel according to an embodiment of the present disclosure. FIG. 18 is a cross-sectional view taken along cross-sectional line I-I in FIG. 17. The supporter 2200 according to an embodiment of the present disclosure will now be described with reference to FIGS. 16 to 18.

The supporter 2200 may include a supporter front surface portion 2210, a supporter upper surface portion 2220, and a supporter lower surface portion 2230. The supporter upper surface portion 2220 may be formed at the upper side of the supporter front surface portion 2210. The supporter upper surface portion 2220 may extend backwards from the upper end of the supporter front surface portion 2210. The supporter lower surface portion 2230 may be formed at the lower side of the supporter front surface portion 2210. The supporter lower surface portion 2230 may extend backwards from the lower end of the supporter front surface portion 2210.

The supporter upper surface portion 2220 and the supporter lower surface portion 2230 include plurality of sealing cover couplers 2221 and 2231. Since the sealing cover couplers 2221 and 2231 project backwards from the supporter upper surface portion 2220 and the supporter lower surface portion 2230, it is possible to set the height of the control panel 2000 in an up-and-down direction to be low according to a desired design and to increase the height of the electrical component module 3000, which is advantageous in assurance of the surface area of the circuit board, the surface area of the flat display and the like. In an embodiment, the supporter upper surface portion 2220 may be provided with the first sealing cover coupler 2221. The supporter upper portion 2230 may be provided with the second sealing cover coupler 2231. The first sealing cover coupler 2221 may include two first sealing cover couplers. The plurality of first sealing cover couplers 2221 may be formed at locations, which are spaced apart from each other by a determined distance. The second sealing cover coupler 2231 may include three second sealing cover couplers. The plurality of second sealing cover couplers 2231 may be formed at locations, which are spaced apart from one another by a determined distance. The first sealing cover coupler 2221 may be coupled to a first supporter coupler 2323 (see FIG. 19) formed at the sealing cover 2300. The second sealing cover coupler 2231 may be coupled to a second supporter coupler 2333 (see FIG. 19) formed at the sealing cover 2300. In an embodiment, each of the sealing cover couplers 2221 and 2231 may be provided with a receiving hole. Each of the supporter couplers 2323 and 2333 may be embodied as a protrusion. The protrusions, which serve as the supporter couplers 2323 and 2333, may be received in the receiving holes in the sealing cover couplers 2221 and 2231 in order to couple the supporter 2200 and the sealing cover 2300 to each other.

The receiving hole may be formed in the sealing cover coupler 2221. The receiving hole in the sealing cover coupler 2221 may receive the protrusion formed at the sealing cover 2300.

The supporter front surface portion 2210 may be provided with a display seating portion 2211. The flat display 2400 may be positioned in the display seating portion 2211. The flat display 2400 may be seated in the display seating portion

2211. The display seating portion 2211 may be depressed backwards from the supporter front surface portion 2210. The depth by which the display seating portion 2211 is depressed may correspond to the thickness of the flat display 2400. A cable through hole 2211*a* may be formed through the display seating portion 2211 such that a cable for electrical connection between the flat display 2400 and the circuit board extends through the cable through hole 2211*a*. The cable through hole 2211*a* may be formed at the lower end of the display seating portion 2211.

A first sealing groove 2219 may be formed in the region of the supporter front surface portion 2210 outside the display seating portion 2211. A first sealer 2820 (see FIG. 24) may be inserted into the sealing groove 2219.

The supporter front surface portion 2210 may be provided with a speaker seating portion 2212. A speaker module may be disposed at the speaker seating portion 2212. A speaker hole 2212*a* may be formed through the speaker seating portion 2212 such that sound from the speaker is transmitted. The speaker seating portion 2212 may be formed at a location at which the speaker seating portion 2212 does not overlap the sealing cover 2300 when viewed from the front. The speaker seating portion 2212 may be formed the region outside the region defined by the first sealing groove 2219.

A wireless communication module seating portion 2213 may be formed at the supporter front surface portion 2210. A wireless communication module may be disposed at the wireless communication module seating portion 2213. A communication hole 2213*a* may be formed in the wireless communication module seating portion 2213 to facilitate smooth wireless communication. The wireless communication may be implemented by Wi-Fi, Bluetooth or the like. The wireless communication module seating portion 2213 may be formed in the region outside the region defined by the first sealing groove 2219.

A touch film through hole 2214 may be formed in the supporter front surface portion 2210 such that a touch film 2119 (see FIG. 24) passes through the touch film through hole 2214 to the rear side of the supporter 220 at which the circuit board is positioned.

A second sealing groove 2218 may be formed in the supporter 2200. The second sealing groove 2218 may be formed at the rear side of the supporter 2200. The second sealing groove 2218 may be formed so as to surround a first region in which the circuit board for the flat display 2400 is disposed. The first region may be defined by a forward periphery which defines the first space 2390 to be described later. The second sealing groove 2218 may be formed at a location at which the second sealing groove 2218 faces the sealing projection 2320 (see FIG. 19) which is formed along the periphery of the sealing cover 2300 and projects forwards therefrom. The sealing projection 2320 may be inserted into the second sealing groove 2218. A second sealer 2810 may be inserted into the second sealing groove 2218. The sealing cover 2300 may be coupled to the supporter 2200 in the state in which the second sealer 2810 is inserted into the second sealing groove 2218. By coupling the supporter 2200 to the sealing cover 2300, the sealing projection 2320 and the second sealer 2810 may be in close contact with each other. For coupling with the supporter 2200, the sealing projection 2320 of the sealing cover 2300 may be inserted into the second sealing groove 2218. At this time, the second sealer 2810 may be pressed, thereby sealing the first space 2390 (see FIG. 21) which is the space defined by the supporter 2200 and the sealing cover 2300. The second sealer 2810 may be made of various materials, such as rubber, fluorine, silicone or the like.

The first sealing groove 2219 may be formed in the supporter 2200. The first sealing groove 2219 may be formed at the front side of the supporter front surface portion 2210 of the supporter 2200. The first sealer 2820 may be inserted into the first sealing groove 2219. The first sealing groove 2219 may be formed in the region outside the display seating portion 2211 so as to surround the display seating portion 2211. The upper and lower portions of the first sealing groove 2219 may be formed so as to face the upper and lower portions of the second sealing groove 2218 with the supporter front surface portion 2210 interposed therebetween. The first sealer 2820 may be made of various materials, such as rubber, fluorine, silicone or the like.

Intermediate grooves 2225 and 2235 may be formed between the second sealing groove 2218 and the first sealing groove 2219. The intermediate grooves 2225 and 2235 may include an upper intermediate groove 2225 and a lower intermediate groove 2235. The upper intermediate groove 2225 may be formed in the supporter upper surface portion 2220. The upper intermediate groove 2225 may be formed in a portion between the second sealing groove 2218 and the first sealing groove 2219 so as to open upwards. The outward direction of the supporter upper surface portion 2220 may be an upward direction. The lower intermediate groove 2235 may be formed in the supporter lower surface portion 2230. The lower intermediate groove 2235 may be formed in a portion between the second sealing groove 2218 and the first sealing groove 2219 so as to open downwards. The outward direction of the supporter lower surface portion 2230 may be a downward direction.

According to an embodiment of the present disclosure, setting of the depth of the second sealing groove 2218 is limited. When the depth of the second sealing groove 2218 is increased, it is possible to sufficiently press the second sealer 2810 only when the length of the sealing projection 2320 is increased. However, when the length of the sealing projection 2320 is increased, it is difficult to perform smooth coupling using a protrusion. Therefore, setting of the depth of the second sealing groove 2218 is limited. Because the bottom surface of the second sealing groove 2218, which defines the depth of the second sealing groove 2218, is positioned at the rear side, it is possible to reduce the length of the sealing projection 2320 of the sealing cover 2300. According to an embodiment of the present disclosure, because the depth of the second sealing groove 2218 is decreased and thus the projecting length of the sealing projection 2320 is also decreased, it is possible to couple the supporter 2200 to the sealing cover 2300 using the protrusion and the groove, and it is possible to sufficiently press the second sealer 2810 to obtain sufficient sealing performance. To this end, the intermediate grooves 2225 and 2235 may be applied.

In an embodiment, the second sealing groove 2218 and the first sealing groove 2219 may face each other at portions thereof. In the portions of the second sealing groove 2218 and the first sealing groove 2219 that face each other, the distance between the second sealing groove 2218 and the first sealing groove 2219 may be greater than the distance between other portions of the second sealing groove 2218 and the first sealing groove 2219. In injection molding of components, there is a need to maintain an appropriate thickness. For example, if one portion is formed to have a thickness greater than another portion, there may be problem in that the thicker portion may warp or break during cooling after injection molding. According to an embodiment of the present disclosure, because the intermediate grooves 2225 and 2235 are provided, it is possible to space the second sealing groove 2218 and the first sealing groove 2219 apart from each other and to uniformly maintain the thickness throughout the supporter 2200.

The second sealing groove 2218 and the first sealing groove 2219 may have the same width. The second sealer 2810 and the first sealer 2820 may have the same diameter. In an embodiment, the second sealer 2810 and the first sealer 2820 may be made one and the same. Accordingly, the second sealer 2810 and the first sealer 2820 may be exchanged with each other, thereby improving convenience in a fabrication operation.

The supporter 220 may be provided at the rear side thereof with coupling bosses 2215. The coupling bosses 2215 may be formed at location corresponding to screw couplers 2330 (see FIG. 19) of the sealing cover 2300. The coupling bosses 2215 may be formed in the region outside the second sealing groove 2218. In an embodiment, the screw coupler 2330 of the sealing cover 2300 may project in rightward and leftward directions of the sealing projection 2320. The coupling bosses 2215 may be coupled to the screw couplers 2330 via screw elements 900 (see FIG. 20). Because the coupling bosses 2215 and the screw couplers 2330 are coupled to each other by means of the fastening member 900, the supporter 2200 and the sealing cover 2300 may be coupled to each other with higher coupling force. When the supporter 220 and the sealing cover 2300 are strongly coupled to each other, water-tightness and/or air-tightness attributable to the second sealer 2810 may be improved.

The supporter lower surface portion 2230 may have one or more first coupling grooves 2232. The first coupling grooves 2232 may be embodied as grooves formed in the rear end of the supporter lower surface portion 2230. In an embodiment, the first coupling grooves 2232 may include two first coupling grooves formed at two locations, and may be formed at locations near opposite ends of the supporter lower surface portion 2230. The first coupling grooves 2232 may be coupled to the second restrainers 2133. The second restraining protrusions 2133*a* of the second restrainers 2133 may be inserted into the first coupling grooves 2232. The width of at least one of the one or more first coupling holes 2232 may be equal to the width of a corresponding to the first coupling hole. Here, the term "equal" may be a concept including a tolerance. The second restraining protrusions 2133*a* may be positioned behind the first coupling grooves 2232 so as to restrain forward and backward movement of the supporter 2200. The second constraining protrusions 2133*a* may be inserted into the first coupling grooves 2232 so as to restrain rightward and leftward movement of the supporter 2200. Because the second restraining protrusions 2133*a* are inserted into the first coupling grooves 2232, the position of the supporter 2200 with respect to the cover panel 2100 may be restrained. Furthermore, because the position of the supporter 2200 is restrained, the position of the electrical component module 3000 may be restrained.

The supporter upper surface portion 2220 may be provided with one or more second coupling grooves 2222. The second coupling grooves 2222 may be embodied as grooves formed in the rear end of the supporter upper surface portion 2220. In an embodiment, the second coupling grooves 2222 may be formed at two locations near opposite ends of the supporter upper surface portion 2220. The second coupling grooves 2222 may be coupled to the third restrainers 2125. The third restraining protrusions 2125*a* of the third restrainers 2125 may be inserted into the second coupling grooves 2222. The width of at least one of the second coupling groove 2222 of the one or more second coupling grooves 2222 may be equal to the width of a corresponding third restraining protrusion 2125*a*. Here, the term "equal" may be a concept including tolerance. The third restraining protrusions 2125*a* may be positioned behind the second coupling grooves 2222 so as to restrain forward and backward movement of the supporter 2200. The third restraining protrusions 2125*a* may be inserted into the second coupling grooves 2222 so as to restrain rightward and leftward movement of the supporter 2200. Because the third restraining protrusions 2125*a* are inserted into the second coupling grooves 2222, the position of the supporter 2200 with respect to the cover panel 2100 may be restrained. Because the position of the supporter 2200 is restrained, the position of the electrical component module 3000 may be restrained.

In an embodiment, the third restrainer 2125 may be formed at the upper surface portion 2120 when the second restrainer 2133 is formed at the lower surface portion 2130 whereas the third restrainer 2125 may be formed at the lower surface portion 2130 when the second restrainer 2133 is formed at the upper surface portion. By virtue of the second restrainer 2133 and the third restrainer 2125, the position of the supporter 2200 in an up-and-down direction may be restrained, thereby making it possible to couple the cover panel 2100 to the electrical component module 3000.

Figure 19:
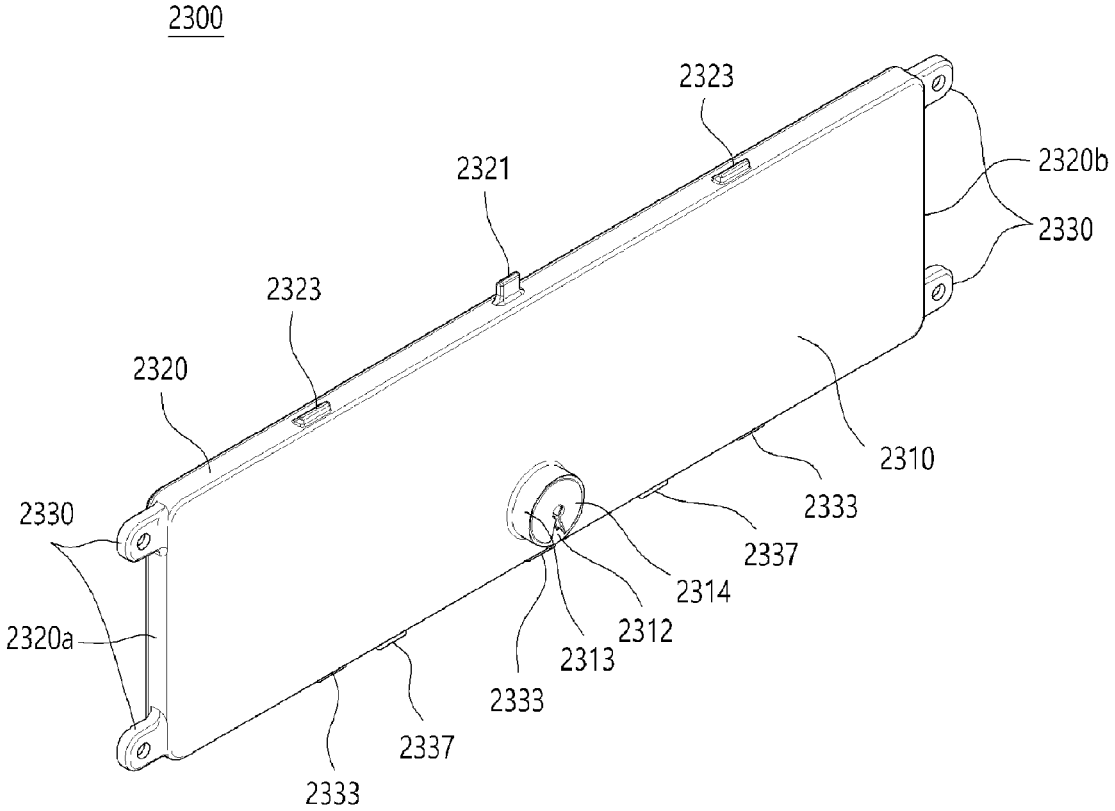
FIG. 19 is a rear perspective view of a sealing cover constituting the control panel according to an embodiment of the present disclosure.

FIG. 19 is a rear perspective view of the sealing cover constituting the control panel according to an embodiment of the present disclosure. The sealing cover 2300 will now be described with reference to FIG. 19.

The sealing cover 2300 may include a sealing cover front surface portion 2310 and the sealing projection 2320.

The sealing cover front surface portion 2310 may define the front surface of the sealing cover 2300. In an embodiment, the sealing cover front surface portion 2310 may be formed so as to have a surface area smaller than the supporter front surface portion 2210. The speaker seating portion 2212 and the sealing cover front surface portion 2310 may be positioned so as not to overlap each other. The sealing cover front surface portion 2310 may be coupled to the supporter 220 at a portion thereof which does not overlap the speaker seating portion 2212. The wireless communication module seating portion 2213 and the sealing cover front surface portion 2310 may be positioned so as not to overlap each other. The sealing cover front surface portion 2310 may be coupled to the supporter 2200 at a portion thereof which does not overlap the wireless communication module seating portion 2213.

The sealing projection 2320 may extend forwards along the periphery of the sealing cover front surface portion 2310. The sealing projection 2320 may be inserted into the second sealing groove 2218. The sealing projection 2320 may be formed to have a shape corresponding to the second sealing groove 2218. Although the sealing projection 2320 has been described as extending forwards along the periphery of the sealing cover front surface portion 2310, sealing projection 2320 may not extend along the periphery of the sealing cover front surface portion 2310 as long as the sealing projection 2320 has a shape corresponding to the second sealing groove 2218.

The upper portion of the sealing projection 2320 may be provided with the first supporter coupler 2323. The first supporter coupler 2323 may be coupled to the sealing cover coupler 2221 of the supporter 2200. The first supporter coupler 2323 may be formed to have the shape of a protrusion. The protrusion of the first supporter coupler 2323 may be received in the receiving hole in the first sealing cover coupler 2221. By virtue of the coupling of the first supporter coupler 2323 with the first sealing cover coupler 2221, the supporter 2200 and the sealing cover 2300 may be coupled to each other. The coupling of the first supporter coupler 2323 with the first sealing cover coupler 2221 may be performed at a location at which the sealing cover 2300 can sufficiently press the second sealer 2810.

The lower portion of the sealing projection 2320 may be provided with the second supporter coupler 2333. The first supporter coupler 2323 may be coupled to the second sealing cover coupler 2231 of the supporter 2200. The second supporter coupler 2333 may be formed to have the shape of a protrusion. The protrusion of the second supporter coupler 2333 may be received in the receiving hole in the second sealing cover coupler 2231. By virtue of the coupling of the second supporter coupler 2333 with the second sealing cover coupler 2231, the supporter 2200 and the sealing cover 2300 may be coupled to each other. The coupling of the second supporter coupler 2333 with the second sealing cover coupler 2231 may be performed at a location at which the sealing cover 2300 can sufficiently press the first sealer 2820.

Because the first supporter coupler 2323 and the first sealing cover coupler 2221 are coupled to each other at an upper side and the second supporter coupler 2333 and the second sealing cover coupler 2231 are coupled to each other at a lower side, the supporter 2200 and the sealing cover 2300 may be fixed to each other in an up-and-down direction.

In an embodiment, the coupling stability between the supporter 2200 and the sealing cover 2300 may be low only by the coupling of the supporter couplers 2323 and 2333 with the sealing cover couplers 2221 and 2231. In order to compensate for this, a screw coupling structure may be additionally provided. In an embodiment, the right and left sides of the sealing projection 2320 may be provided with the screw coupler 2330. The screw coupler 2330 may project from the sealing projection 2320. In an embodiment, the screw coupler 2330 may include a protrusion projecting from the sealing projection 2320 and a screw through hole formed through the protrusion. The rear side of the supporter 2200 may be provided with the coupling boss 2215 at a location corresponding to the screw coupler 2330. The screw coupler 2330 may be coupled to the coupling boss 2215 by means of the screw element 900. In an embodiment, the screw coupler 2330 may include two screw couplers disposed at the left side and two screw couplers disposed at the right side. When a plurality of screw couplers 2330 are formed at each side, the plurality of screw couplers 2330 may be spaced apart from each other by a predetermined distance. By virtue of the screw coupling of the screw coupler 2330 with the coupling boss 2215, it is possible to improve the coupling stability between the supporter 2200 and the sealing cover 2300. Because the screw coupler 2330 can be coupled to the coupling boss 2215 by applying torque using the screw element 900, it is also possible to increase the coupling strength. Because the screw couplers 2330 are formed at the right and left sides of sealing cover 2300, the second sealer 2810 can also be sufficiently pressed at the left side 2320*a* and the right side 2320*b* of the sealing projection 2320.

The sealing cover 2300 may include the cover panel coupler 2321. The cover panel coupler 2321 may be a component configured to couple the electrical component module 3000 to the cover panel 2100. The cover panel coupler 2321 may be embodied as a protrusion. In an embodiment, the cover panel coupler 2321 may be provided as a cover panel coupling protrusion 2321.

The cover panel coupling protrusion 2321 may project from one of the upper portion and the lower portion of the sealing cover 2300. In an embodiment, the cover panel coupling protrusion 2321 may project from the center of the upper portion of the sealing cover 2300. The protrusion-receiving hole 2121*a* of the electrical component module coupler 2121 may be formed at a location corresponding to the cover panel coupling protrusion 2321. When the cover panel coupling protrusion 2321 is inserted into and received in the protrusion-receiving hole 2121*a* and thus coupled thereto, the position of the electrical component module 3000 with respect to the cover panel 2100 may be restrained. When the cover panel coupling protrusion 2321 is inserted into and received in the protrusion-receiving hole 2121*a* and thus coupled thereto, the electrical component module 3000 may be coupled to the cover panel 2100.

The sealing cover 2300 may include the cover panel engaging protrusion 2337. The cover panel engaging protrusion 2337 may be a component configured to push and restrain the electrical component module 3000 in a direction of the front surface portion 2110 of the cover panel 2100. The cover panel engaging protrusion 2337 may be pressed forwards by the first restraining protrusion 2131 of the cover panel 2100. The first restraining protrusion 2131*a* of the first restrainer 2131 may be positioned behind the cover panel engaging protrusion 2337, and may elastically press the cover panel engaging protrusion 2337. The elasticity of the first restraining protrusion may be created by the slit 2131*c*. In an embodiment, the cover panel engaging protrusion 2337 may be inserted into the opening 2131*d* in the first restrainer 2131, and may be pressed by the first restraining protrusion 2131*a*.

The sealing cover front surface portion 2310 may be provided with a wiring hole 2312. A cable (not shown) for transmission of power may access the circuit board 2500 and/or the flat display 2400 through the wiring hole 2312. A wiring hole projection 2313 may be formed around the wiring hole 2312. The wiring hole projection 2313 may extend in a backward direction of the wiring hole 2312. The wiring hole projection 2313 may be provided with a wiring hole sealer 2341. The wiring hole sealer 2314 may be inserted into the wiring hole projection 2313. The wiring hole sealer 2314 may seal the wiring hole 2312. Accordingly, by virtue of the wiring hole projection 2313, the wiring hole sealer 2314 may assure a length sufficient to obtain water-tightness and/or air-tightness. The wiring hole sealer 2314 may seal the remaining space other than the space through which the cable (not shown) extends.

Figure 20:
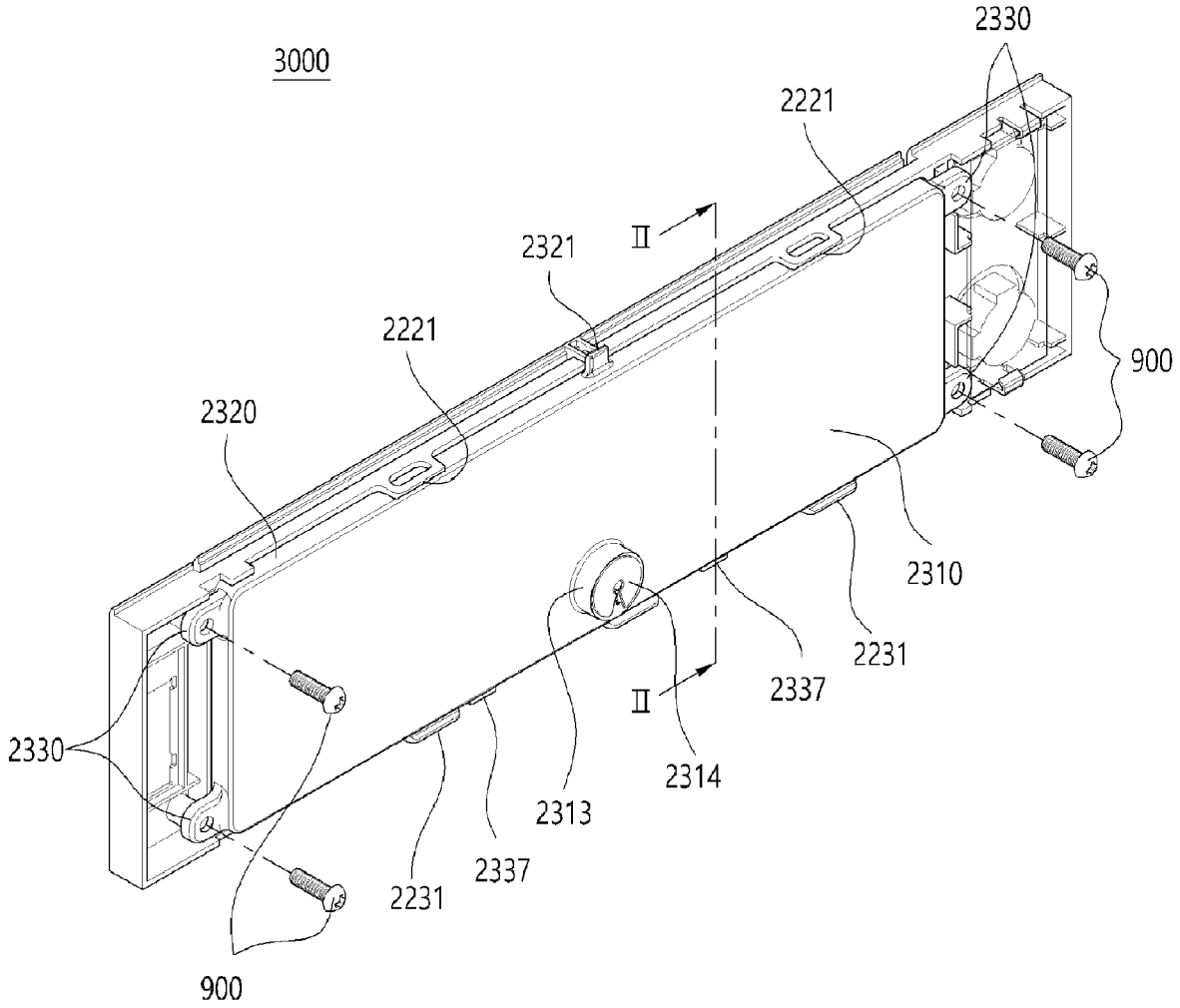
FIG. 20 is a rear perspective view of an electrical component module according to an embodiment of the present disclosure.
Figure 21:
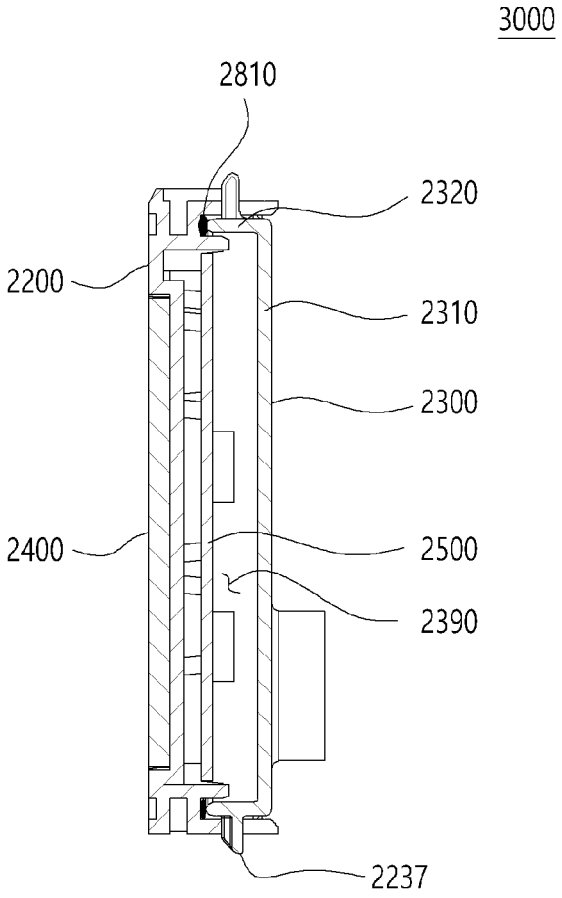
FIG. 21 is a cross-sectional view taken along cross-sectional line II-II in FIG. 20.

FIG. 20 is a rear perspective view of the electrical component module according to an embodiment of the present disclosure. FIG. 21 is a cross-sectional view taken along cross-sectional line II-II in FIG. 20. The coupling relationships between components constituting the electrical component module 3000 according to an embodiment of the present disclosure will now be described with reference to FIGS. 20 and 21.

The first sealing cover coupler 2221 of the supporter upper surface portion 2220 may be coupled to the first supporter coupler 2323 (see FIG. 19) of the sealing cover 2300. The second sealing cover coupler 2231 of the supporter upper surface portion 2220 may be coupled to the second supporter coupler 2333 (see FIG. 19) of the sealing cover 2300. Because the first sealing cover coupler 2221 and the second sealing cover coupler 2231 projects backwards from the supporter upper surface portion 2220 and the supporter lower surface portion 2230, respectively, it is possible to reduce the height of the electrical component module 3000.

The screw coupler 2330 of the sealing cover 2300 may be coupled to the coupling boss 2215 (see FIG. 17) of the supporter 2200. The screw coupler 2430 and the coupling boss 2215 may be threadedly coupled to each other by means of the screw element 900. Because the screw coupler 2330 can be coupled to the coupling boss 2215 by applying torque using the screw element 900, it is also possible to increase coupling strength. Because the screw couplers 2330 are formed at the right and left sides of the sealing cover 2300, the second sealer 2810 may also be sufficiently pressed at the right side (2320*b*) and the left side (2320*a*) of the sealing projection 2320. Furthermore, because the screw coupling provides high coupling force, it is possible to improve coupling stability between the supporter 2200 and the sealing cover 2300.

The sealing projection 2320 may come into contact with the second sealer 2810 disposed in the second sealing groove 2218 and may press the second sealer 2810. In an embodiment, the sealing projection 2320 may be inserted into the second sealing groove 2218. Because the sealing projection 2320 presses the second sealer 2810, the first space 2390 may be isolated from the external space. In an embodiment of the present disclosure, the flat display 2400 may be provided. Because the flat display 2400 is vulnerable to humidity, a sealing structure is needed. According to an embodiment of the present disclosure, it is possible to obtain an appropriate sealing structure capable of protecting the flat display 2400. Because the first space 2390 is isolated from the external space, it is possible to protect the flat display 2400 and the circuit board 2500 for the flat display 2400 from humidity.

The upper end of the cover panel coupler 2321 may project outwards farther than the outer peripheral portion of the supporter 2200. The lower end of the cover panel engaging protrusion 2337 may project outwards farther than the outer peripheral portion of the supporter 2200.

Figure 22:
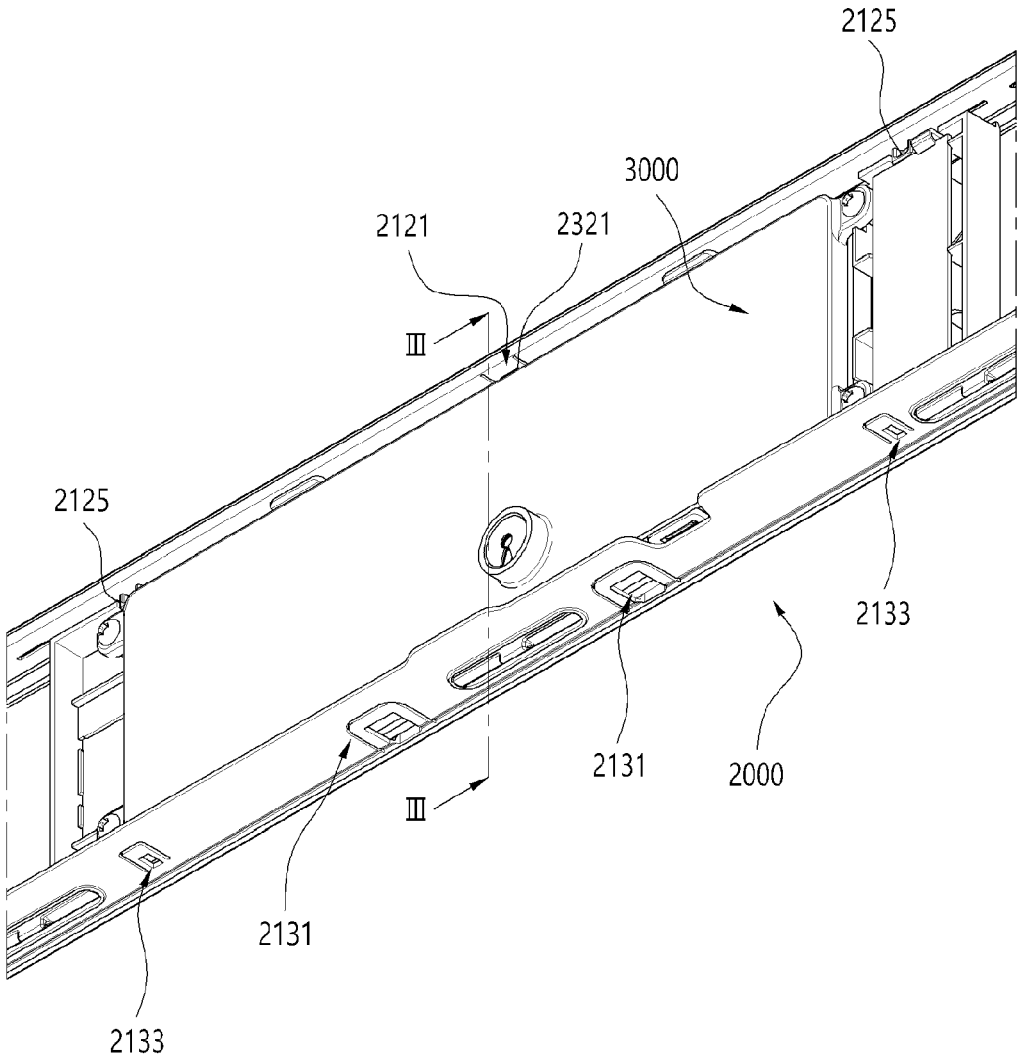
FIG. 22 is an enlarged view of the coupling portion between the electrical component module and the cover panel according to an embodiment of the present disclosure when viewed from the rear in order to explain coupling between the electrical component module and the cover panel.
Figure 23:
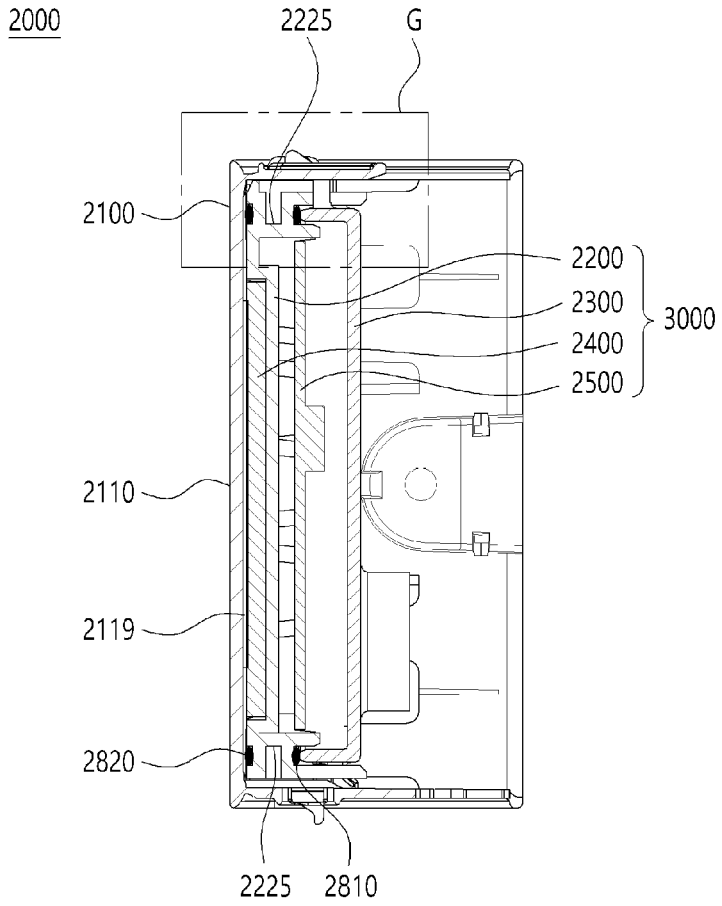
FIG. 23 is a cross-sectional view taken along cross-sectional line III-III in FIG. 24.

FIG. 22 is an enlarged view of the coupling portion between the electrical component module and the cover panel according to an embodiment of the present disclosure when viewed from the rear in order to explain the coupling between the electrical component module and the cover panel. FIG. 23 is a cross-sectional view taken along cross-sectional line III-III in FIG. 24. The coupling between the electrical component module 3000 and the cover panel 2100 according to an embodiment of the present disclosure will now be described with reference to FIGS. 22 and 23.

The first restrainer 2131 of the cover panel 2100 may press the cover panel engaging protrusion 2337 (see FIG. 20) from the rear to restrain the cover panel engaging protrusion 2337. The second restrainer 2133 of the cover panel 2100 may be coupled to the first coupling groove 2232 (see FIG. 17) of the supporter lower surface portion 2230. The third restrainer 2125 of the cover panel 2100 may be coupled to the first coupling groove 2232 (see FIG. 17) of the supporter upper surface portion 2220. The electrical component module coupler 2121 of the cover panel 2100 may be coupled to the cover panel coupling protrusion 2321 (see FIG. 20).

The flat display 2400 may be positioned ahead of the supporter 2200. The touch film 2119 may be provided ahead of the flat display 2400. The touch film 2119 may be adhered to the rear surface of the cover panel 2100. The touch film 2119 may be electrically connected to the circuit board 2500. The laundry treatment apparatus 1 may receive user commands via the touch film 2119.

The electrical component module 3000 may be coupled to the rear side of the cover panel 2100. In an embodiment, the electrical component module 3000 may be received in the space defined by the front surface portion 2110, the upper surface portion 2120, the lower surface portion 2130, the first lateral surface portion 2142 and the second lateral surface portion 2144 of the cover panel 2100.

By virtue of the coupling between the cover panel 2100 and the supporter 2200, the first sealer 2820 may be in close contact with the cover panel 2100. By virtue of the close contact between the first sealer 2820 and the cover panel 2100, the space in which the flat display 2400 is seated may be isolated from the external space. When the supporter 2200 and the cover panel 2100 are strongly coupled to each other, water-tightness and air-tightness attributable to the first sealer 2820 may be improved. Because the flat display 2400 is vulnerable to humidity, there is a need to provide a sealing structure. According to an embodiment of the present disclosure, it is possible to obtain an appropriate sealing structure capable of protecting the first sealer 2820. By virtue of the first sealer 2820, the flat display 2400 may be isolated from the external space and thus be protected from humidity.

Figure 24:
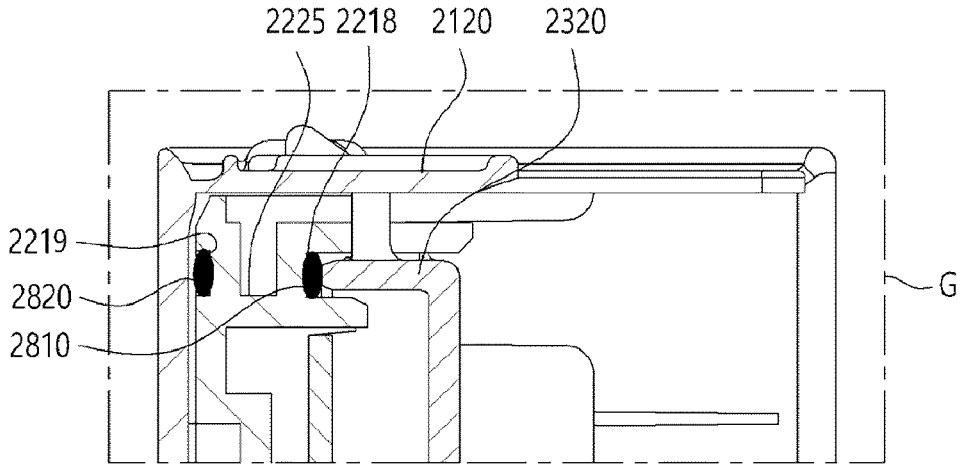
FIG. 24 is a fragmentary enlarged view of portion G in FIG. 23.

FIG. 24 is a fragmentary enlarged view of portion G in FIG. 23. The sealing structure according to an embodiment of the present disclosure will now be described with reference to FIG. 24.

The second sealer 2810 may be inserted into the second sealing groove 2218, and may exert sealing performance by being pressed by the sealing projection 2320. The first sealer 2820 may be inserted into the first sealing groove 2219 so as to come into contact with the front surface portion 2110, and may exert sealing performance by the pressing force with the electrical component module 3000 is coupled to the cover panel 2100.

Figure 25:
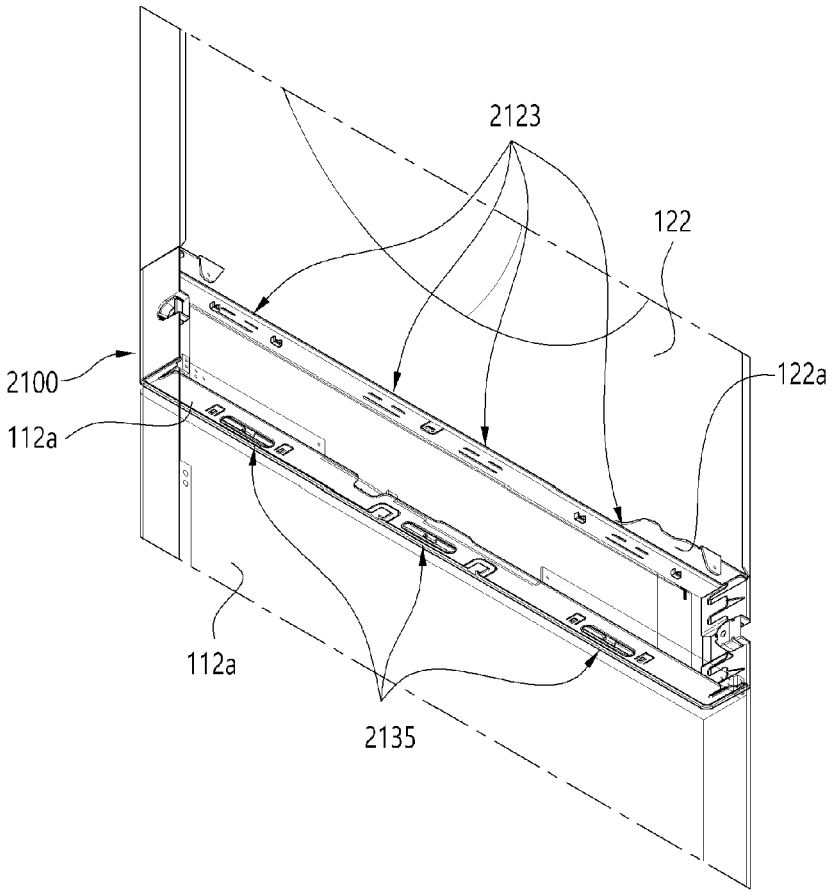
FIG. 25 is a view illustrating the state in which the cover panel according to an embodiment of the present disclosure is coupled to the first front panel and the second front panel when viewed from the inner side.

FIG. 25 is a view illustrating the state in which the cover panel according to an embodiment of the present disclosure is coupled to the first front panel and the second front panel when viewed from the inner side. The coupling between the cover panel 2100 and the first front panel 112 and the second front panel 122 will now be described with reference to FIG. 25.

In an embodiment, the control panel 2000 may be coupled to the first front panel 112 and the second front panel 122 via the cover panel 2100.

The lower surface portion 2130 of the cover panel 2100 may be coupled to an upper end bent portion 112*a* of the first front panel 112 of the first treatment apparatus 10. The cover panel 2100 and the first front panel 112 may be coupled to each other by inserting the first front panel coupler 2135 of the lower surface portion 2130 into the upper end bent portion 112*a*.

The upper surface portion 2120 of the cover panel 2100 may be coupled to a lower end bent portion 122*a* of the second front panel 122 of the second treatment apparatus 20. The cover panel 2100 may be coupled to the second front panel 122 by inserting the second front panel coupler 2123 into a coupling hole (not shown) in the lower end bent portion 122*a*.

Figure 26:
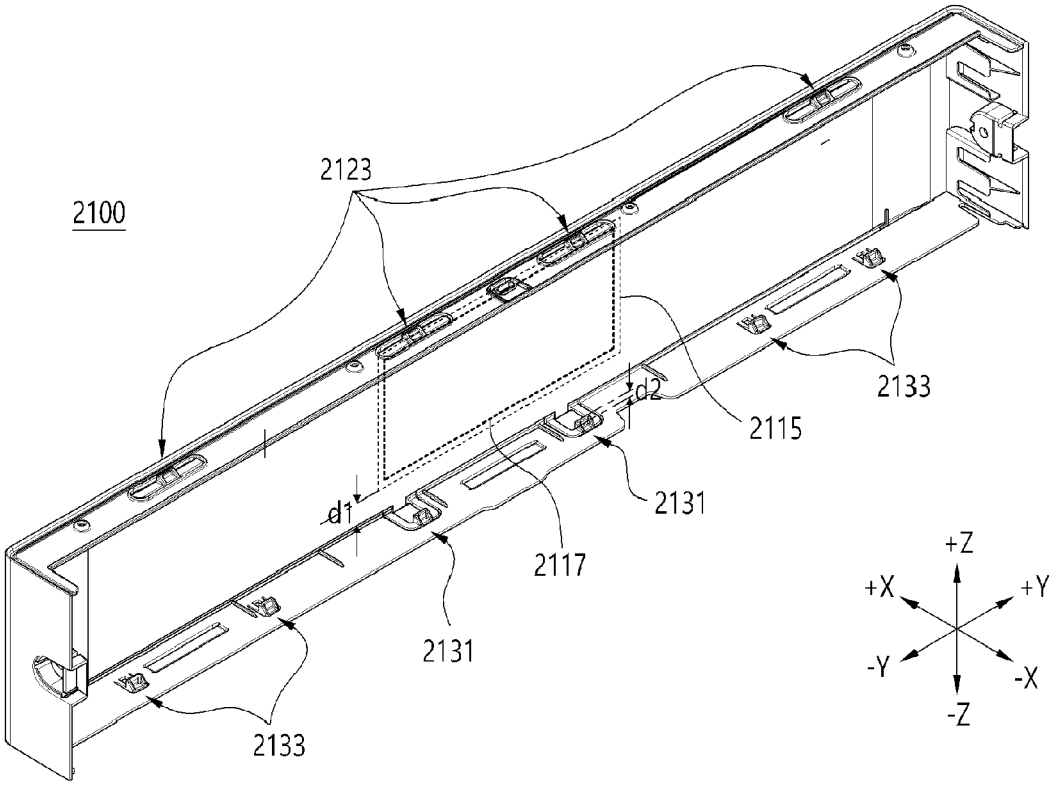
FIG. 26 is a perspective view of the cover panel according to an embodiment of the present disclosure when viewed from the inner side.

FIG. 26 is a perspective view of the cover panel according to an embodiment of the present disclosure when viewed from the inner side. The cover panel according to an embodiment of the present disclosure will now be de additionally described with reference to FIG. 26.

The control panel 2000 according to an embodiment of the present disclosure may include the flat display 2400. When the region of the front surface portion 2110 in which the flat display 2400 is provided does not have a uniform thickness, the quality of the screen which is transmitted through the cover panel 2100 is not good. For example, fine projections are formed in the region in which the flat display 2400 is provided due to various causes occurring in a manufacturing process, the quality of the screen which is transmitted through the cover panel 2100 may be deteriorated.

In an embodiment of the present disclosure, the cover panel 2100 may include a uniform zone 2115. The inner region of the uniform zone 2115 may be formed by a surface having no projecting portion. The flat surface which constitutes the uniform zone 2115 may form a uniform surface. The uniform zone 2115 may be larger than the region which is occupied by the screen of the flat display 2400. The flat display 2400 may be positioned in the region in which the flat display 2400 overlaps the uniform zone 2115. When viewed from the front, the portion 2117 to which the flat display 2400 is projected may be positioned in the uniform zone 2115.

In an embodiment, the uniform zone 2115 may be formed to have a rectangular shape. In an embodiment, the protrusions formed in the region which overlaps the uniform zone 2115 in an up-and-down direction do not overlap the uniform zone 2115 when viewed from the front (the front surface or the front side). In an embodiment, the first restraining protrusion 2131*a* may overlap the uniform zone 2115 in an up-and-down direction. The height h1 that the first restraining protrusion 2131*a* projects may be less than the distance d1 between the lower surface of the uniform zone 2115 and the lower surface of the front surface portion 2110. Consequently, the uniform zone 2115 does not overlap the first restraining protrusion 2131*a* when viewed from the front.

Although the present disclosure has been illustrated and described with reference to the specific embodiments, those skilled in the art will appreciate that various modifications, additions and substitutions are possible, without departing from the scope and spirit of the present disclosure as disclosed in the accompanying claims.

What is claimed is:

1. A laundry treatment apparatus comprising:

a first treatment apparatus comprising a first front panel provided at a front side thereof and a first drum configured to receive laundry therein;

a second treatment apparatus disposed on the first treatment apparatus, the second treatment apparatus comprising a second front panel provided at a front side thereof and a second drum configured to receive laundry therein; and a control panel positioned between the first front panel and the second front panel, providing a user interface (UI) configured to control at least one of the first treatment apparatus or the second treatment apparatus, wherein the control panel comprises:

a cover panel defining an exterior of the control panel; and an electrical component module coupled to a rear side of the cover panel, and wherein the electrical component module comprises:

a flat display;

a supporter comprising a display seating portion configured to supporter the flat display; and a first sealing portion which is provided on a front surface of the supporter so as to surround a region outside the display seating portion and at which a first sealer is positioned.

2. The laundry treatment apparatus of claim 1, wherein the supporter is configured to be coupled to the cover panel such that the first sealer comes into contact with the cover panel.

3. The laundry treatment apparatus of claim 1, wherein the first sealing portion comprises a first sealing groove into which the first sealer is inserted.

4. The laundry treatment apparatus of claim 1, further comprising:

a circuit board positioned behind the supporter and electrically connected to the flat display; and a sealing cover positioned behind the circuit board so as to cover the circuit board and coupled to the supporter.

5. The laundry treatment apparatus of claim 4, wherein a rear surface of the supporter is provided with a second sealing portion surrounding a region outside the circuit board and in which a second sealer is positioned, wherein the sealing cover comprises:

a front surface portion; and a sealing projection extending from a portion of the front surface portion that faces the second sealer, and wherein the sealing cover is coupled to the supporter such that the sealing projection comes into contact with the second sealer.

6. The laundry treatment apparatus of claim 5, wherein the second sealing portion comprises a second sealing groove in which the second sealer is inserted.

7. The laundry treatment apparatus of claim 5, wherein the first sealing portion comprises a first sealing groove in which the first sealer is inserted, wherein the second sealing portion comprises a second sealing groove into which the second sealer is inserted, and wherein upper and lower ends of the first sealing groove are configured to be positioned so as to face upper and lower ends of the second sealing groove.

8. The laundry treatment apparatus of claim 7, wherein the supporter comprises:

a supporter front surface portion comprising the display seating portion;

a supporter upper surface portion formed at an upper side of the supporter front surface portion; and a supporter lower surface portion formed at a lower side of the supporter front surface portion, wherein, in the supporter upper surface portion and the supporter lower surface portion, an intermediate groove is configured to be formed between the second sealing groove and the first sealing groove so as to open in an outward direction.

9. The laundry treatment apparatus of claim 4, wherein the supporter comprises:

a supporter front surface portion defining an appearance of the supporter;

a supporter upper surface portion formed at an upper side of the supporter front surface portion; and a supporter lower surface portion formed at a lower side of the supporter front surface portion, wherein each of the supporter upper surface portion and the supporter lower surface portion comprises a sealing cover coupler which projects backwards, and wherein a sealing cover comprises a supporter coupler which is formed at a location corresponding to the sealing cover coupler of the supporter and which is inserted into the sealing cover coupler and coupled thereto.

10. The laundry treatment apparatus of claim 4, wherein the sealing cover further comprises screw couplers formed at right and left sides thereof, wherein the supporter further comprises a coupling boss formed at a location corresponding to the screw coupler, and wherein the screw coupler and the coupling boss are configured to be coupled to each other via a screw element.

11. The laundry treatment apparatus of claim 4, wherein the sealing cover comprises a wiring hole, wherein a cable configured to transmit power to the circuit board is provided to the circuit board through the wiring hole, and wherein the wiring hole is provided with a wiring hole sealer configured to seal the wiring hole.

12. The laundry treatment apparatus of claim 11, wherein the sealing cover comprises a wiring hole projection which projects backwards along a periphery of the wiring hole.

13. The laundry treatment apparatus of claim 4, wherein the sealing cover comprises a cover panel engaging protrusion which projects toward an upper surface portion or a lower surface portion of the cover panel.

14. The laundry treatment apparatus of claim 13, wherein the cover panel comprises a first restraining protrusion which projects inwards from the upper surface portion or the lower surface portion of the cover panel and which is positioned behind the cover panel engaging protrusion so as to restrain the sealing cover.

15. The laundry treatment apparatus of claim 14, wherein the cover panel further comprises a second restraining protrusion, which projects in an inward direction of the cover panel so as to be positioned behind the supporter and which is inserted into a groove formed in the supporter to restrain a position of the supporter.

16. The laundry treatment apparatus of claim 14, wherein the cover panel further comprises a third restraining protrusion which projects in an inward direction from the cover panel so as to be positioned behind the supporter and to constrain a position of the supporter.

17. A laundry treatment apparatus comprising:

a first treatment apparatus comprising a first front panel provided at a front side thereof and a first drum configured to receive laundry therein;

a second treatment apparatus positioned above the first treatment apparatus, the second treatment apparatus comprising a second front panel provided at a front side thereof and a second drum configured to receive laundry therein; and a control panel positioned between the first front panel and the second front panel and providing a user interface (UI) configured to control at least one of the first treatment apparatus or the second treatment apparatus, wherein the control panel comprises:

a cover panel defining the exterior of the control panel; and an electrical component module coupled to a rear side of the cover panel, and wherein the electrical component module comprises:

a flat display;

a supporter comprising a display seating portion configured to supporter the flat display;

a circuit board positioned behind the supporter and electrically connected to the flat display; and a sealing cover positioned behind the circuit board so as to cover the circuit board and coupled to the supporter.

18. The laundry treatment apparatus of claim 17, wherein a rear surface of the supporter is provided with a second sealing portion which surrounds a region outside the circuit board and at which a second sealer is positioned.

19. The laundry treatment apparatus of claim 18, wherein the sealing cover comprises:

a front surface portion; and a sealing projection extending from a portion of the front surface portion that faces the second sealer, and wherein the sealing cover is coupled to the supporter such that the sealing projection comes into contact with the second sealer.

20. The laundry treatment apparatus of claim 19, wherein the second sealing portion comprises a second sealing groove in which the second sealer is inserted.

* * * * *